US006077176A

United States Patent [19]

Poshadlo, Jr.

[11] Patent Number: 6,077,176

[45] Date of Patent: Jun. 20, 2000

[54] TENNIS COURT TRAINER

[76] Inventor: Cliff Poshadlo, Jr., 23243 Lawrence, Dearborn, Mich. 48128

[21] Appl. No.: 07/772,698

[22] Filed: Oct. 7, 1991

[51] Int. Cl.[7] ..... A63B 69/38

[52] U.S. Cl. ..... 473/474

[58] Field of Search ..... 273/55 R, 55 B, 273/29 R, 29 A, 30, 31

[56] References Cited

U.S. PATENT DOCUMENTS

| | | | |
|---|---|---|---|
| 1,897,801 | 2/1933 | Healy | 273/31 |
| 2,005,241 | 6/1935 | Robinson | 273/29 A |
| 3,117,783 | 6/1964 | Reid | 273/30 |
| 3,580,572 | 5/1971 | Noonan | 273/55 R |
| 3,993,306 | 11/1976 | Scott | 273/29 A |
| 4,045,022 | 8/1977 | Grant | 273/29 R |
| 4,088,317 | 5/1978 | Gierla | 473/474 |
| 4,192,503 | 5/1980 | Karas | 273/29 A |
| 4,941,663 | 7/1990 | Walker | 273/29 A |
| 4,948,372 | 8/1990 | Stotland | 273/31 |

FOREIGN PATENT DOCUMENTS

| | | | |
|---|---|---|---|
| 2553001 | 4/1985 | France | 273/29 R |
| 2566280 | 12/1985 | France | 273/30 |
| 3150088 | 6/1983 | Germany | 273/29 A |
| 8605108 | 9/1986 | WIPO | 273/29 A |

*Primary Examiner*—Jeanette Chapman
*Assistant Examiner*—Stephen Blau
*Attorney, Agent, or Firm*—Brooks & Kushman P.C.

[57] ABSTRACT

An improved surface for a tennis court, the playing surface will have designated on it one or more locations to enable greater placement and accuracy in tennis shots. These physical locations are rectangular in nature and correspond in size to sectors or a combination of sectors whose locations are determined by equally dividing a court between the single side lanes and the net and the base line to three lanes vertically and zones horizontally. Smaller rectangular locations within the sectors may also be identified. These rectangular locations may be combinations of one or more subsectors defined by defining a sector into three sublanes and three subzones.

6 Claims, 33 Drawing Sheets

TENNIS COURT TRAINER

FIELD OF THE INVENTION

Figure 0A:
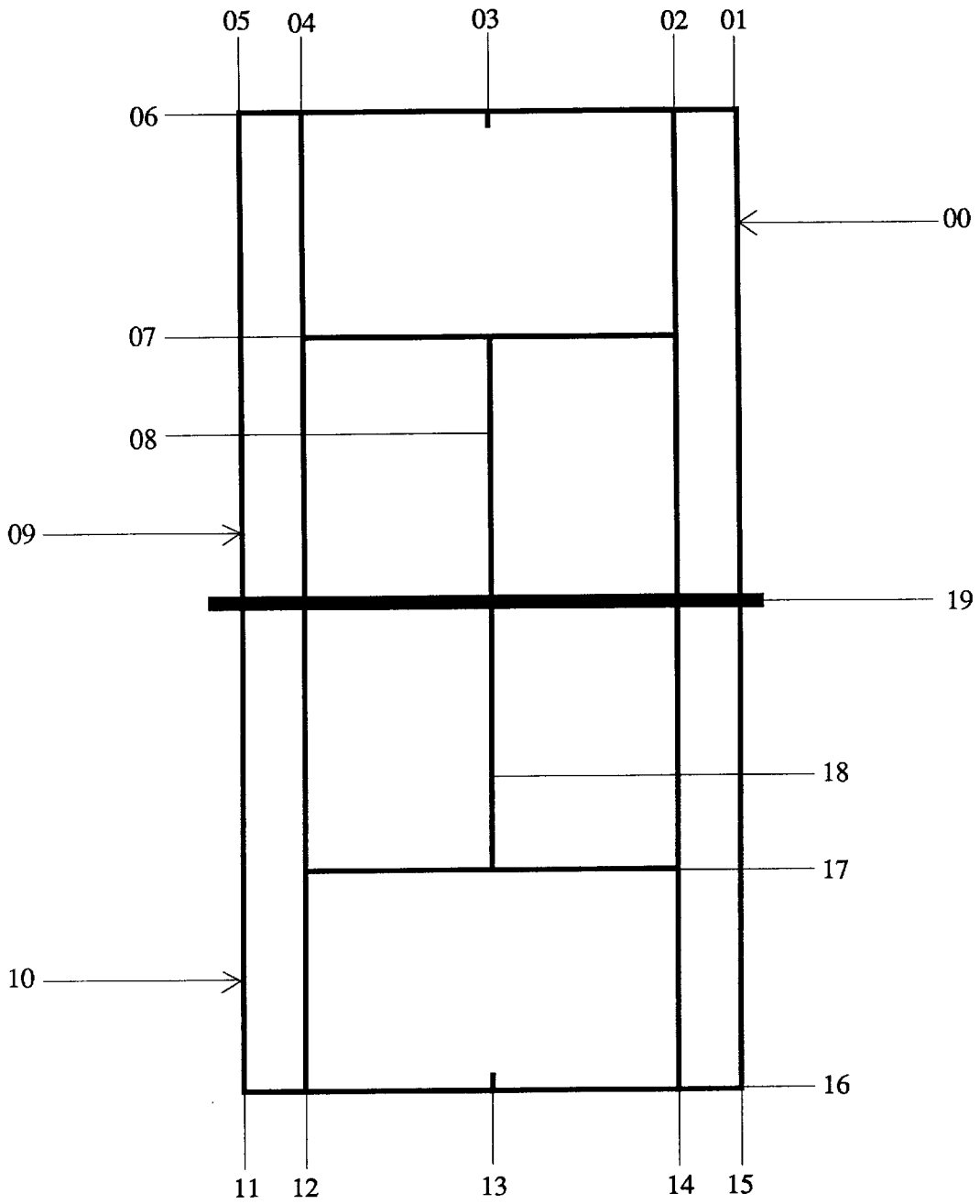

This invention relates to tennis training equipment, specifically to such equipment which is used for the playing surface of a tennis court.

DRAWING FIGURES (36 figures on 33 sheets)

The drawing descriptions (Drawing Figures & Reference Numerals) are presented here, before, not after Background of The Prior Art because they are used to explain the traditional theory which is essential for a clear disclosure of the Description of The Invention and Operation of The Invention which follow afterward.

In the drawings, closely related Drawing Figures have the same number but different letter suffixes; and, closely related Reference Numerals have the same number prefixes. Drawing Figures are single digit, as opposed to Reference Numerals which are double or triple digit. Where appropriate, Figures are cross referenced with Numerals; and, Numerals are cross referenced with Figures.

Figure 0B:
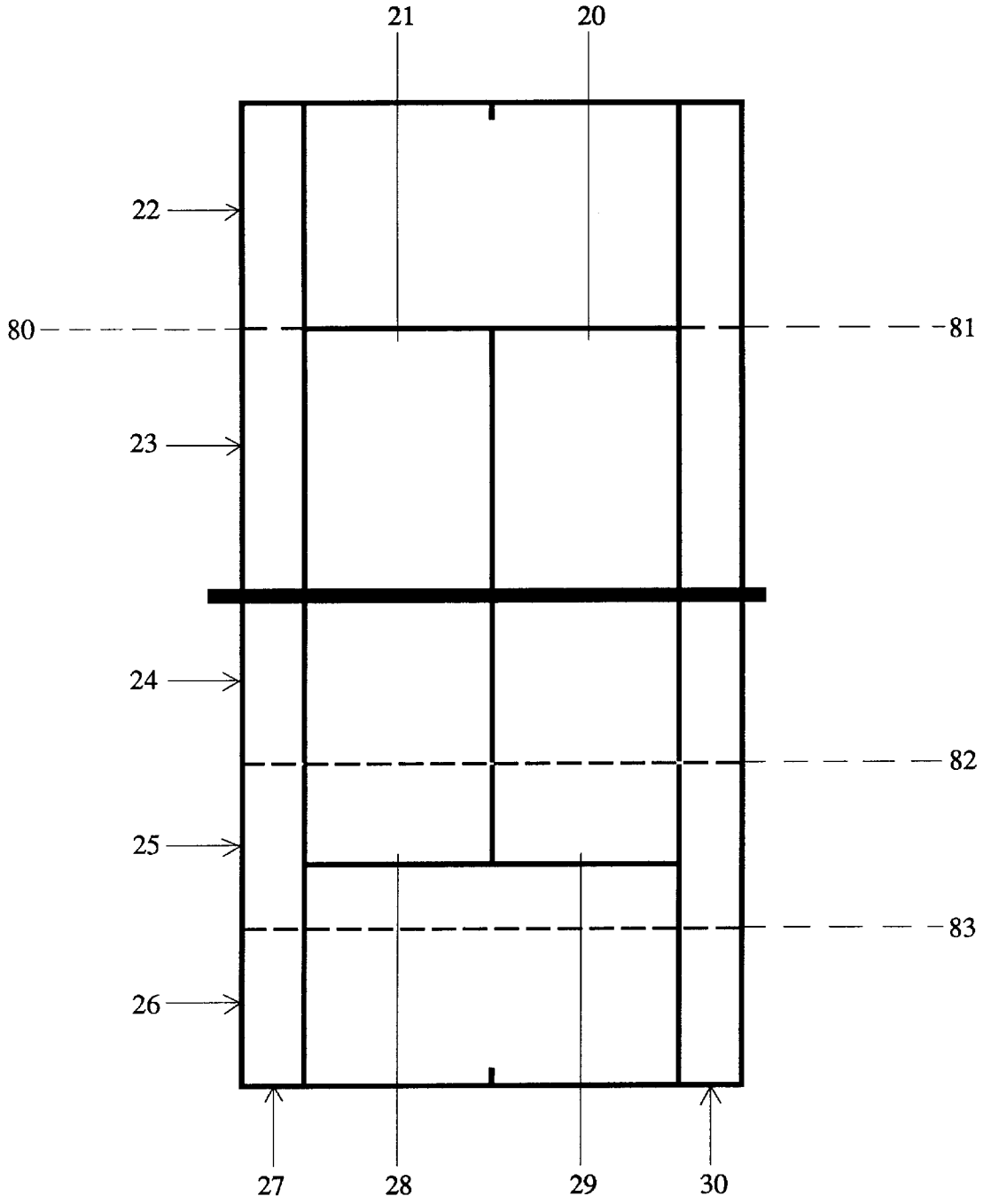
Figure 0C:
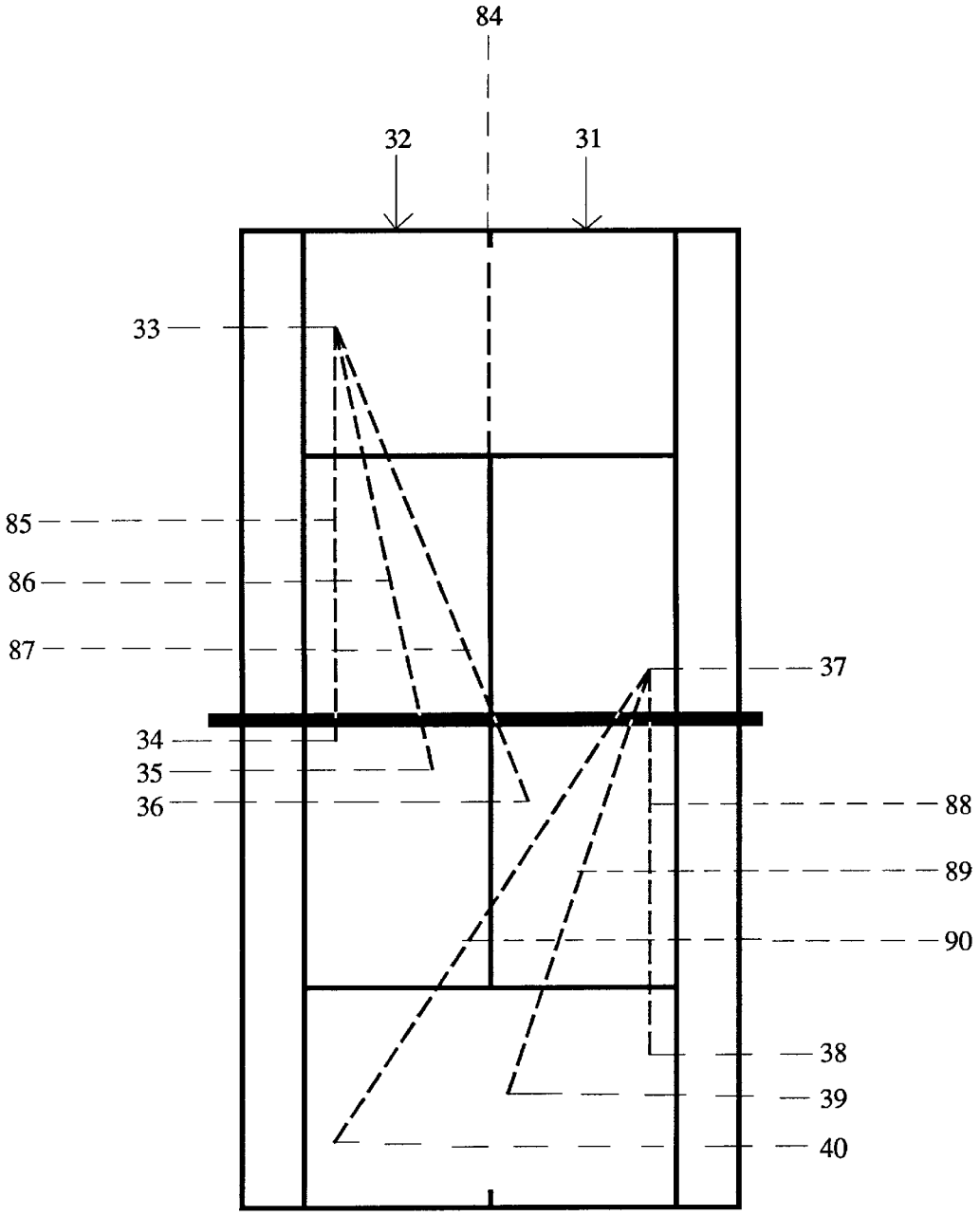

FIGS. 0*a*–0*c* Prior Art

FIG. 0*a* Physical View of tennis court (Reference Numerals 01–19)

FIG. 0*b* Logical View Horizontal Aspect of tennis court (20–30 and 80–83)

FIG. 0*c* Logical View Vertical Aspect of tennis court (31–40 and 84–90)

FIGS. 1*a*–1*d* Full-Size Playing Surface Tennis Court Trainer

Figure 1A:
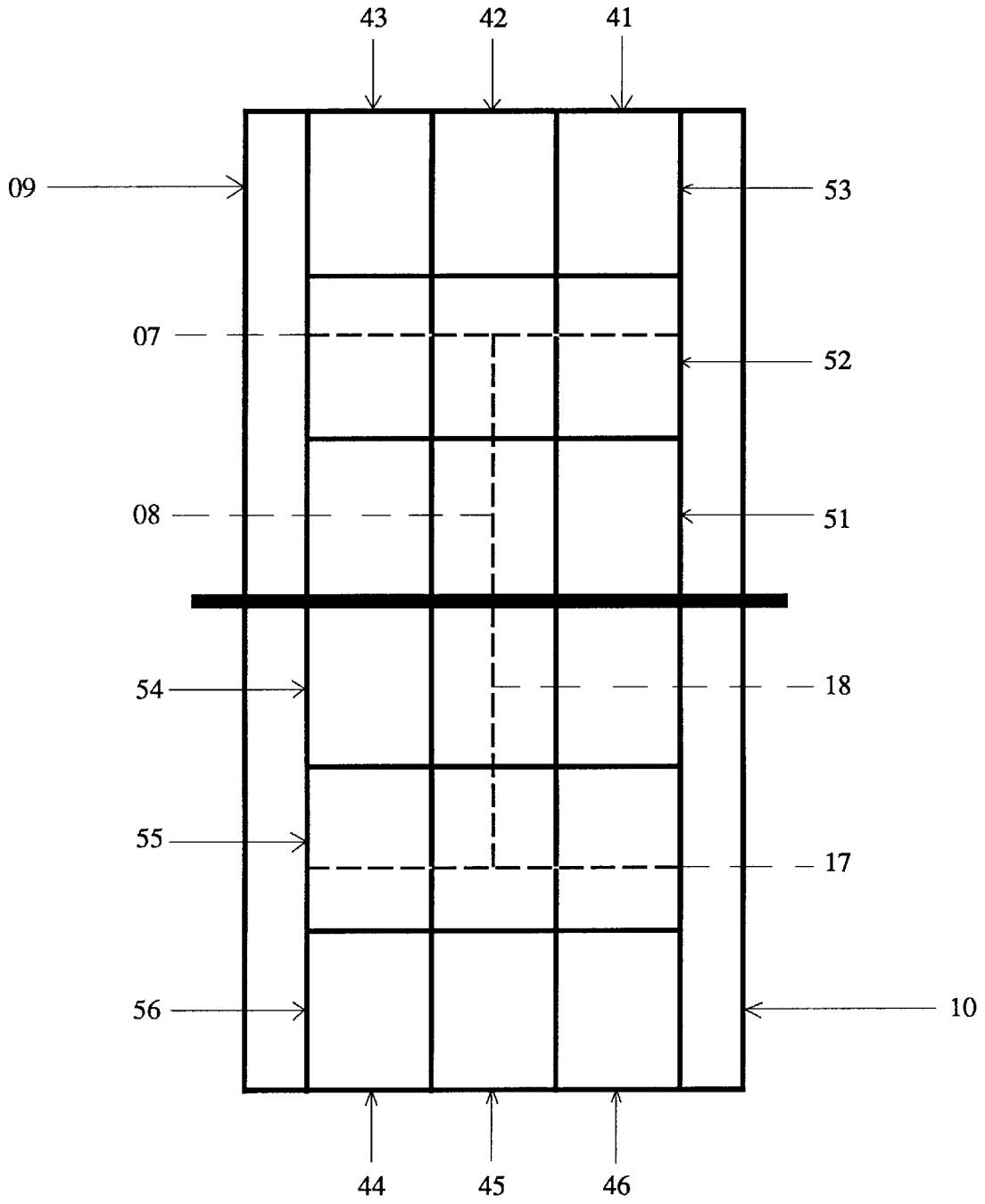

FIG. 1*a* Lanes (41–46) and Zones (51–56)

Figure 1B:
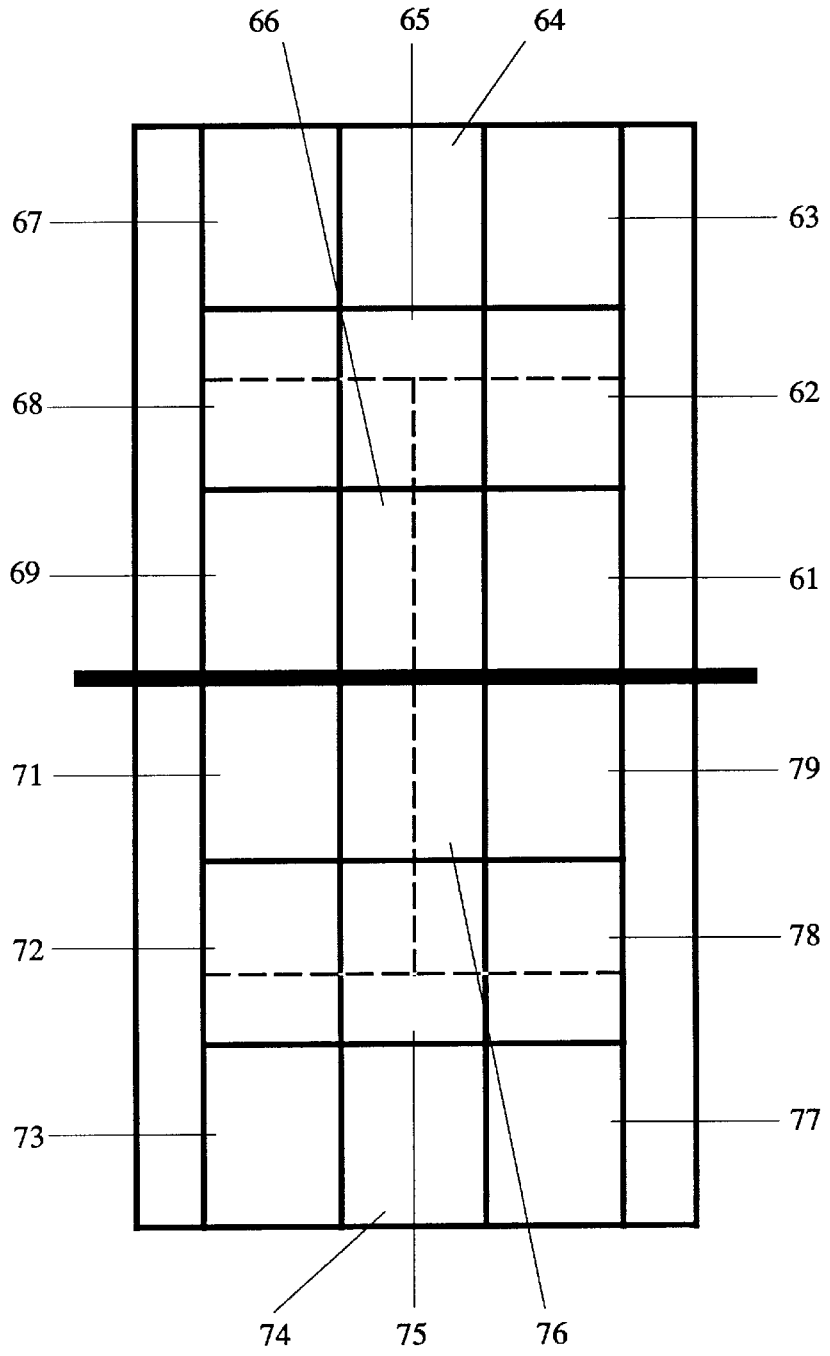

FIG. 1*b* Sectors (61–69 and 71–79)

Figure 1C:
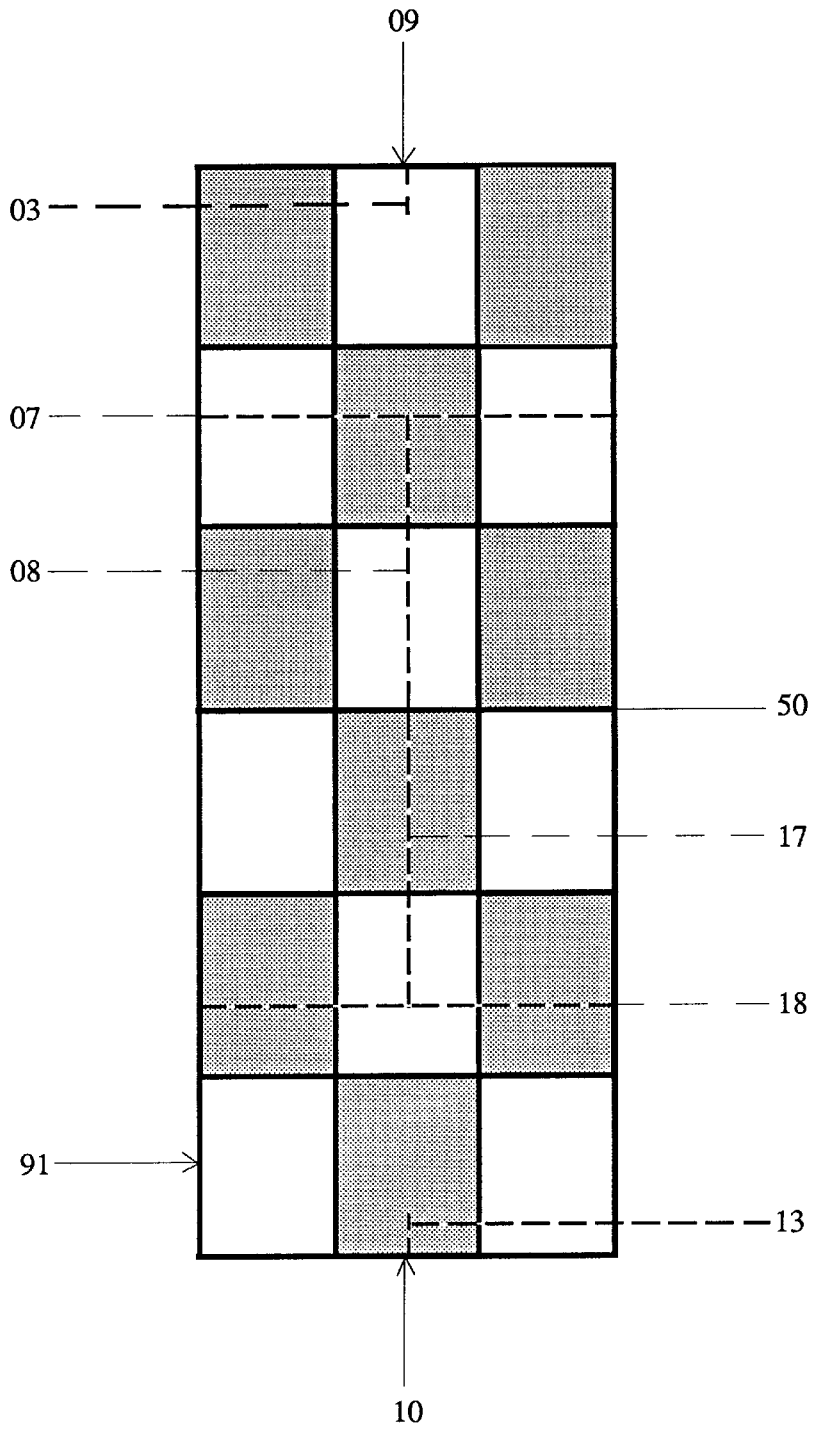

FIG. 1*c* Checkerboard Pattern (50)

Figure 1D:
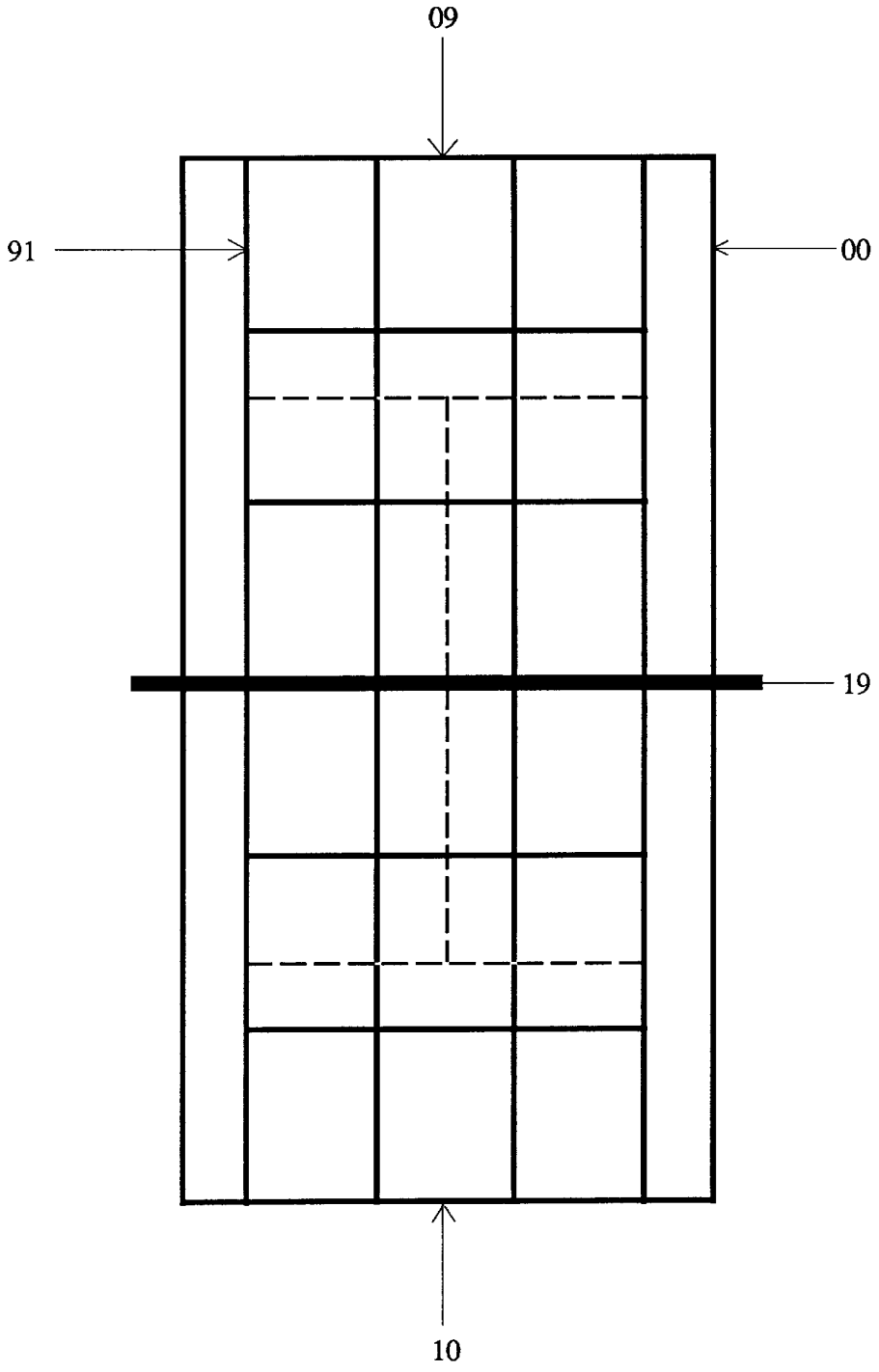

FIG. 1*d* Placement

FIGS. 2*a*–2*d* Half-Size Playing Surface Tennis Court Trainer

Figure 2A:
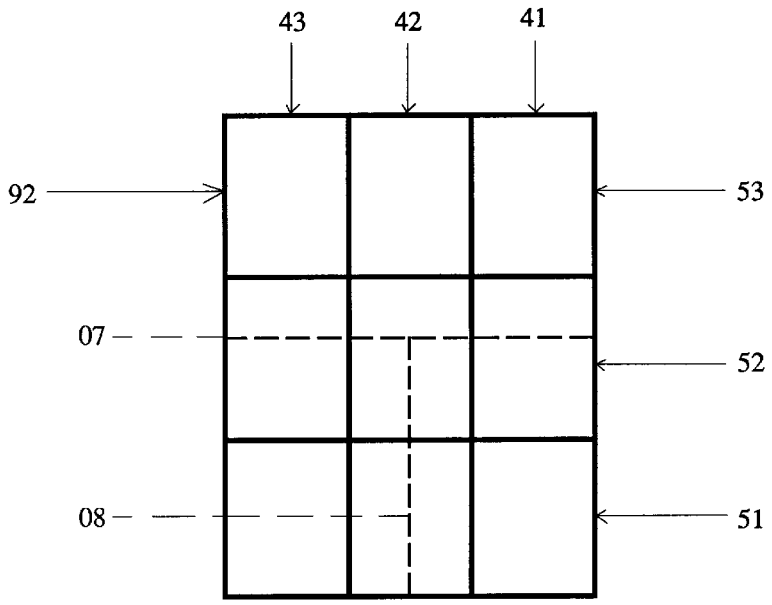

FIG. 2*a* Lanes (41–43 or 44–46) and Zones (51–53 or 54–56)

Figure 2B:
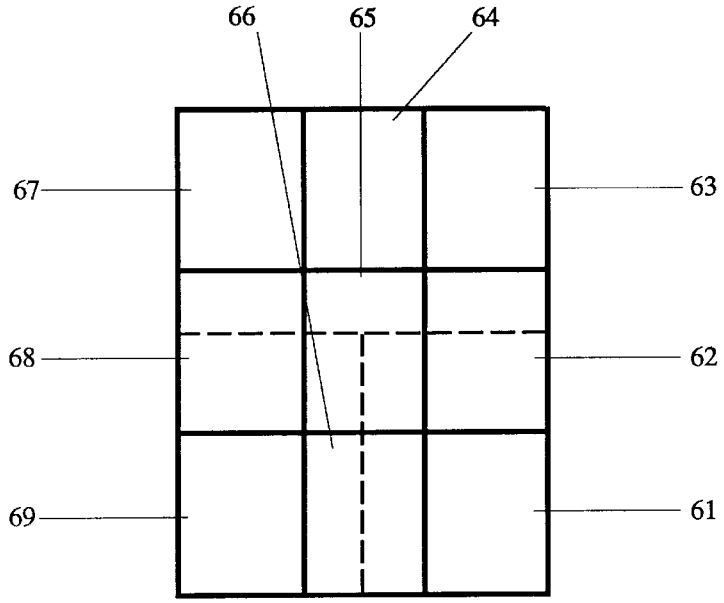

FIG. 2*b* Sectors (61–69 or 71–79)

Figure 2C:
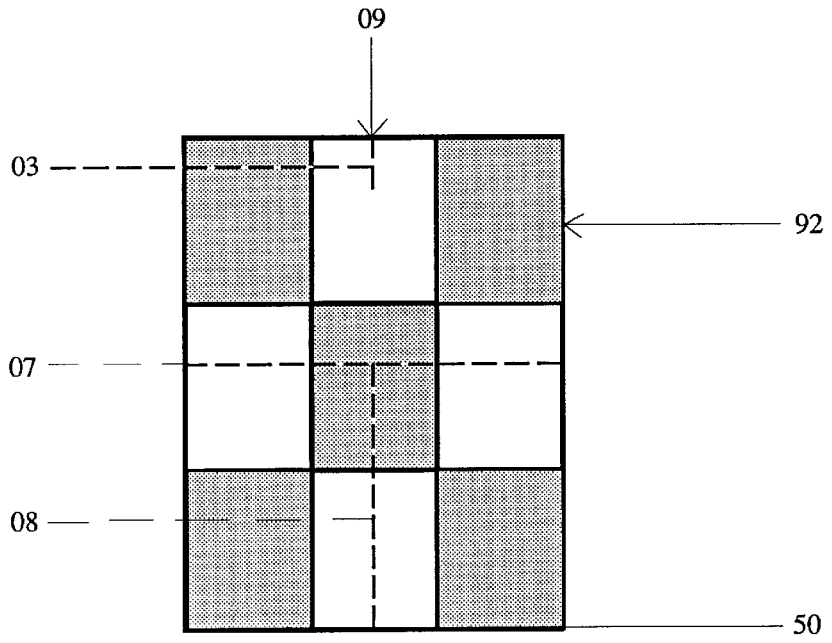

FIG. 2*c* Player Side Checkerboard Pattern

Figure 2D:
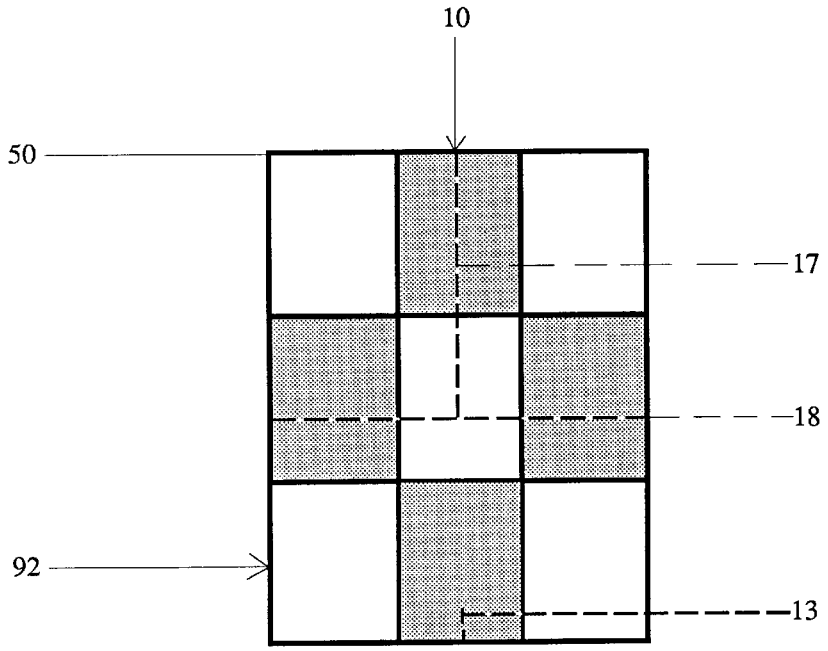

FIG. 2*d* Target Side Checkerboard Pattern

Figure 2E:
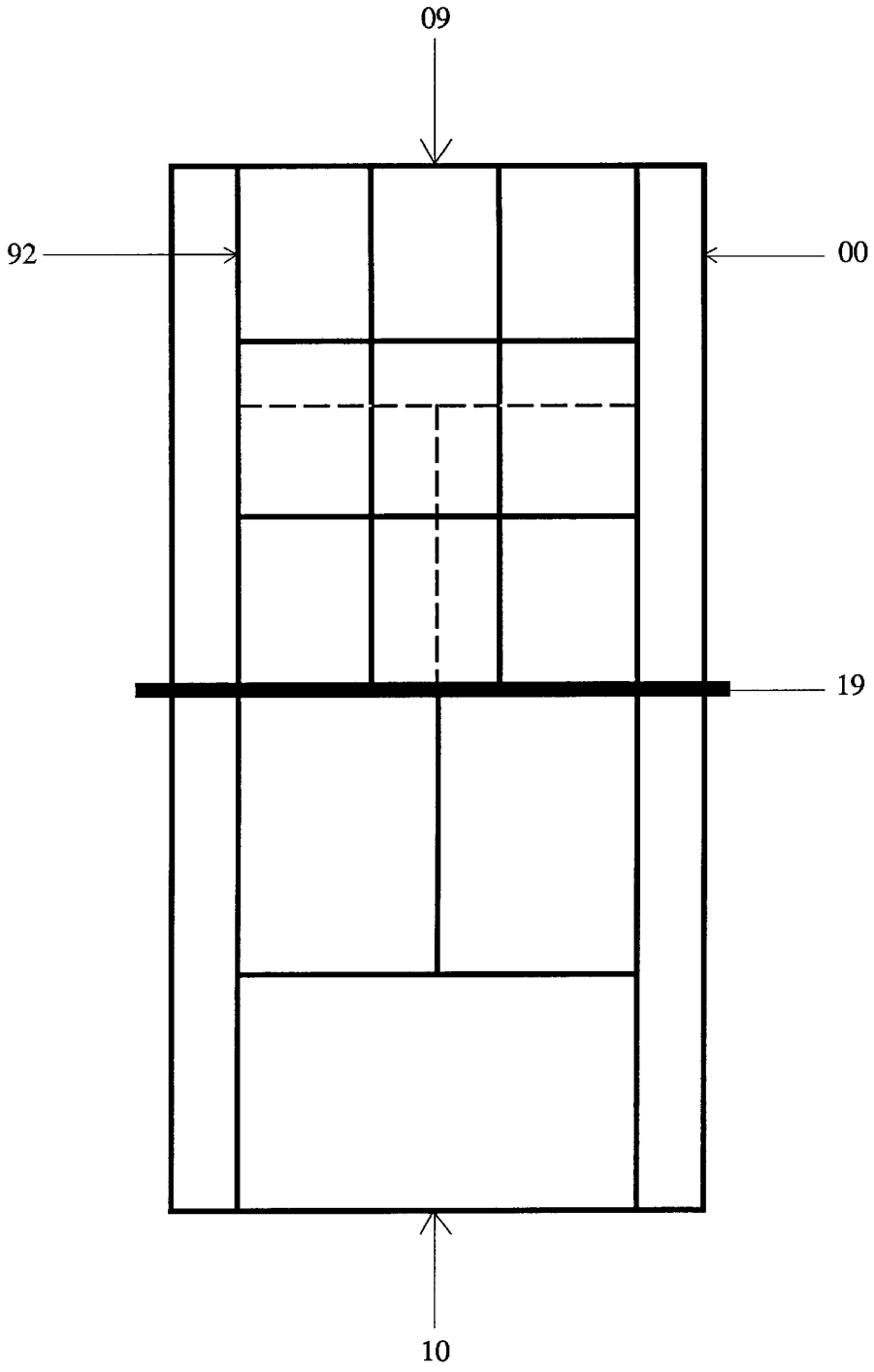

FIG. 2*e* Player Side Placement

Figure 2F:
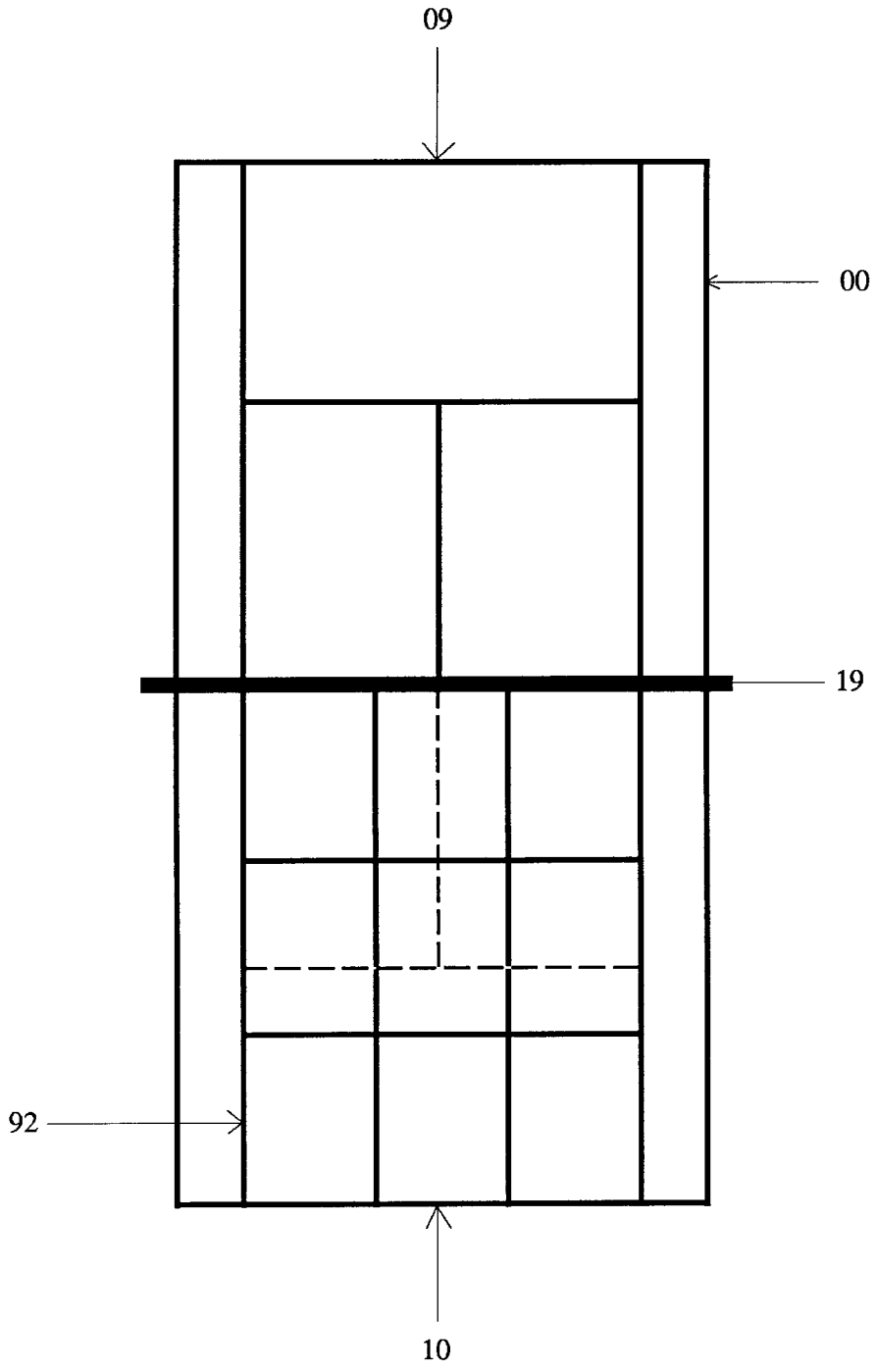

FIG. 2*f* Target Side Placement

Figure 3A:
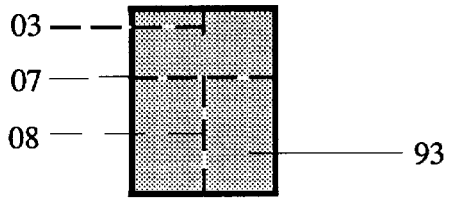

FIGS. 3*a*–3*h* Sector-Size Playing Surface Tennis Court Trainer, Singles Placement FIG. 3*a* Player Side Checkerboard Pattern (dark)

Figure 3B:
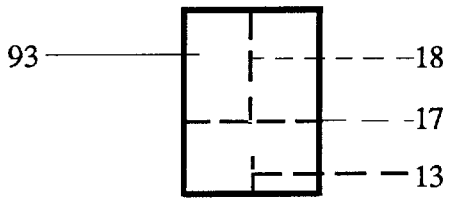

FIG. 3*b* Target Side Checkerboard Pattern (light)

Figure 3C:
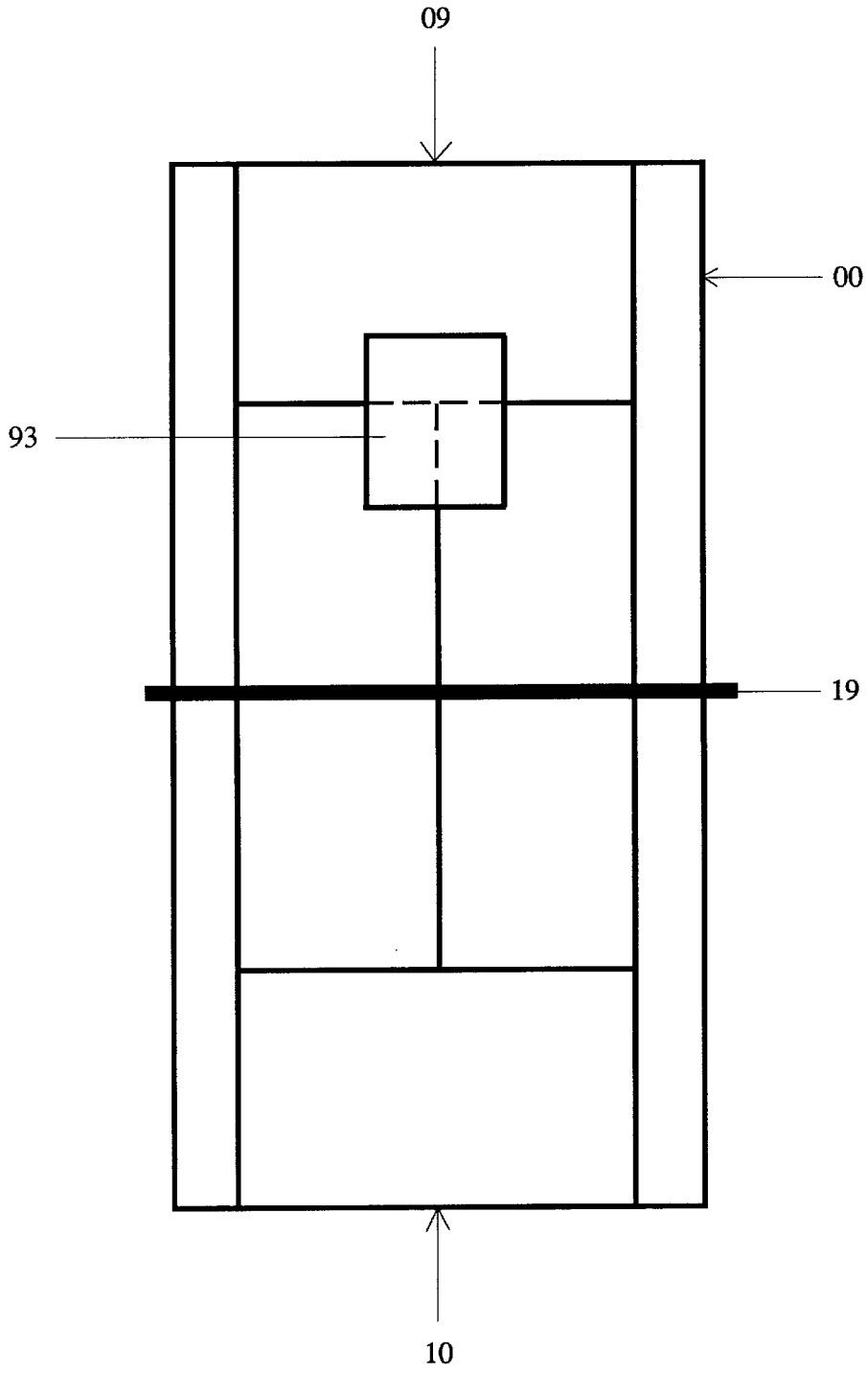

FIG. 3*c* Player Side Singles Placement Example (Player Sector "On Key" location)

Figure 3D:
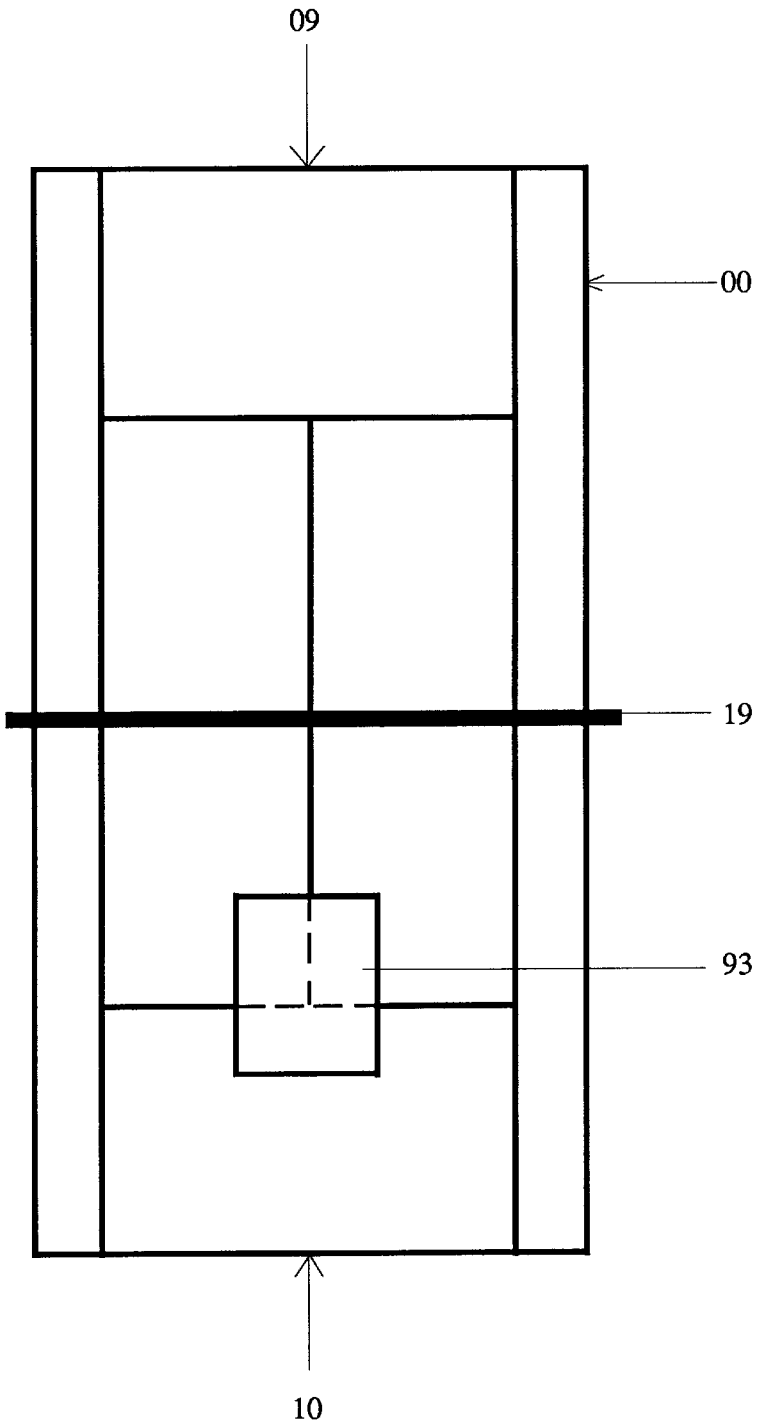

FIG. 3*d* Target Side Singles Placement Example (Target Sector "On Key" location)

Figure 3E:
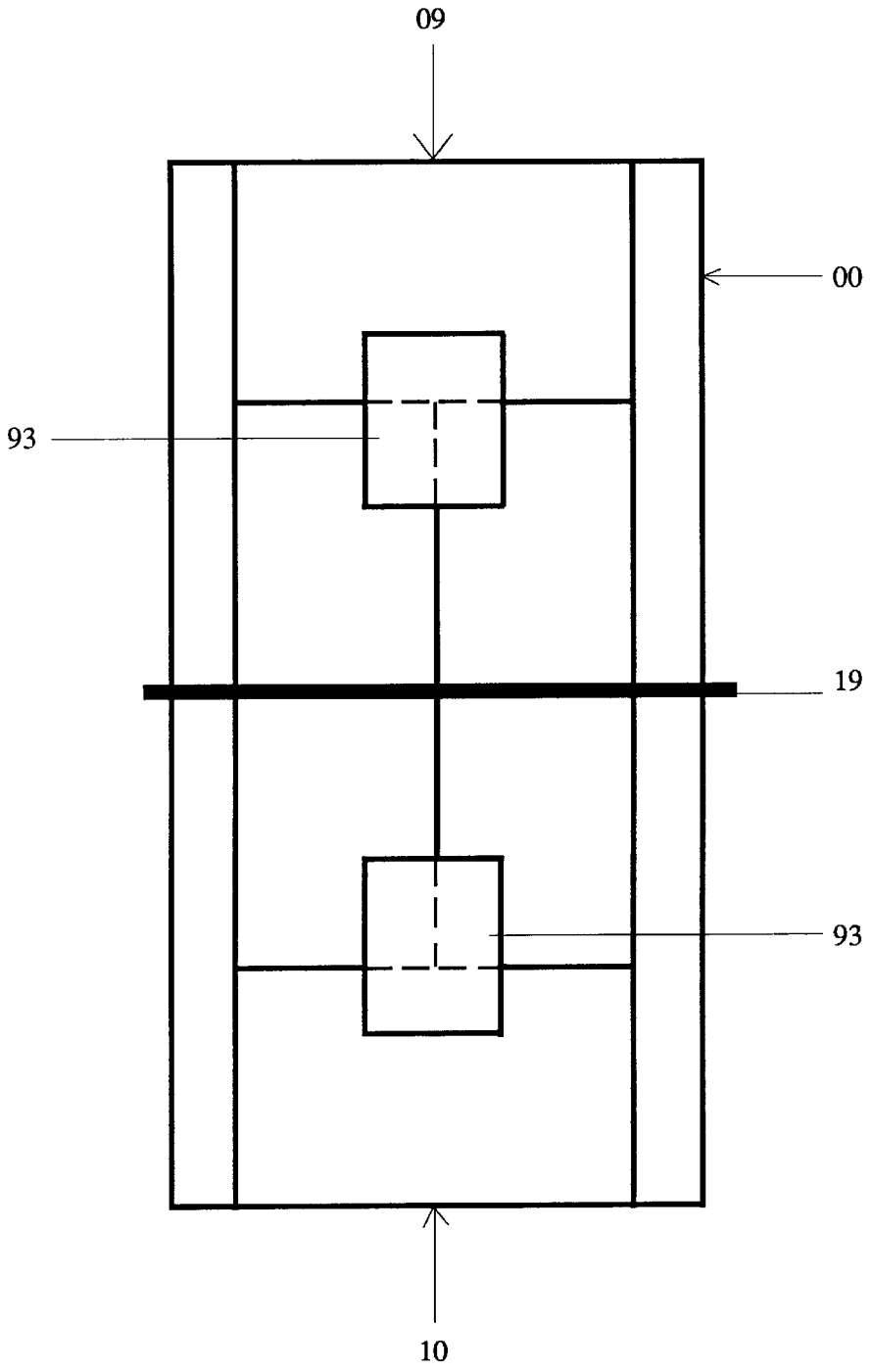

FIG. 3*e* Standard Singles Placement (Player and Target Sectors "On Key" locations)

Figure 3F:
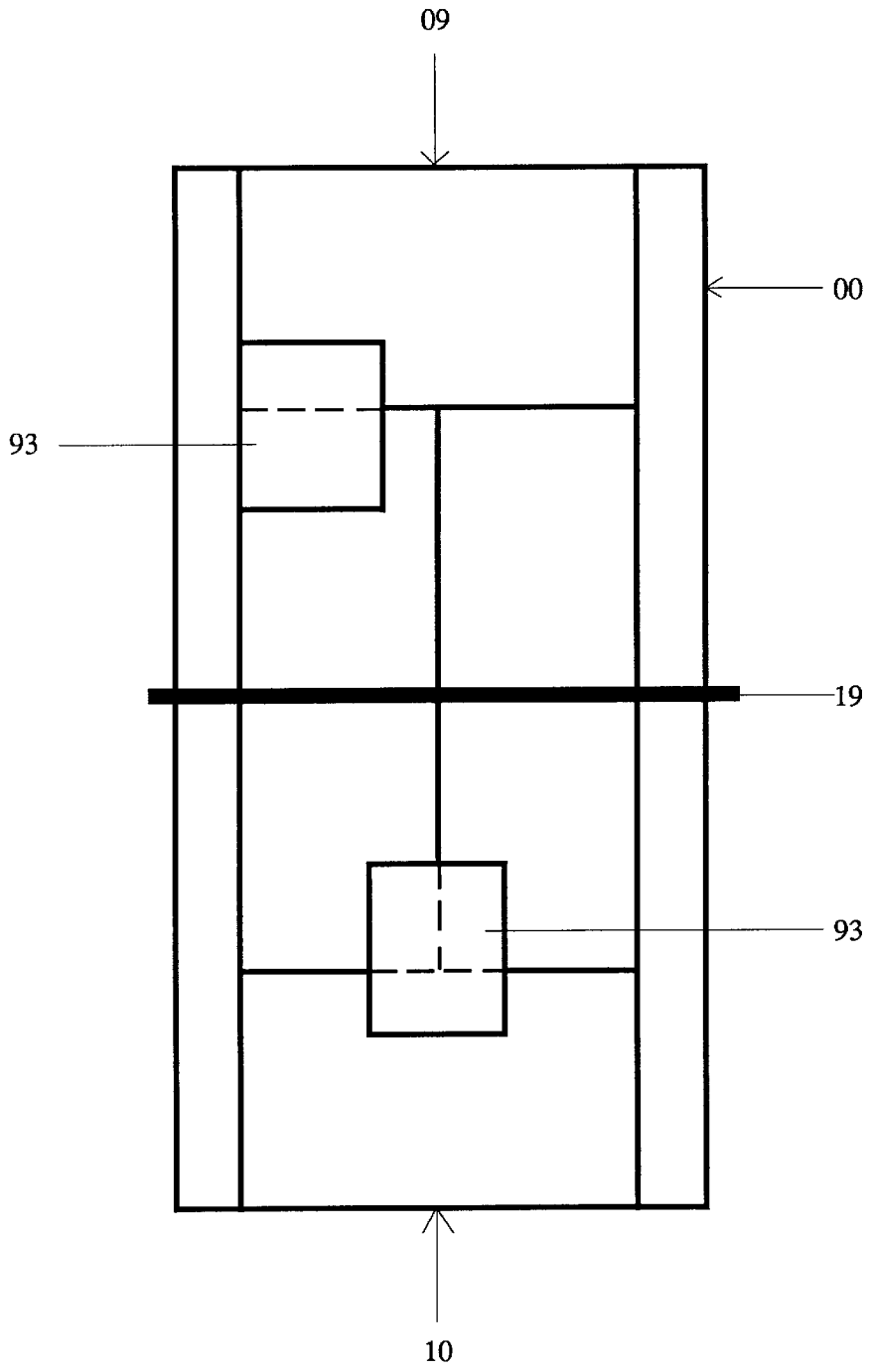

FIG. 3*f* Alternate Player Side Singles Placement "Off Key" Example

Figure 3G:
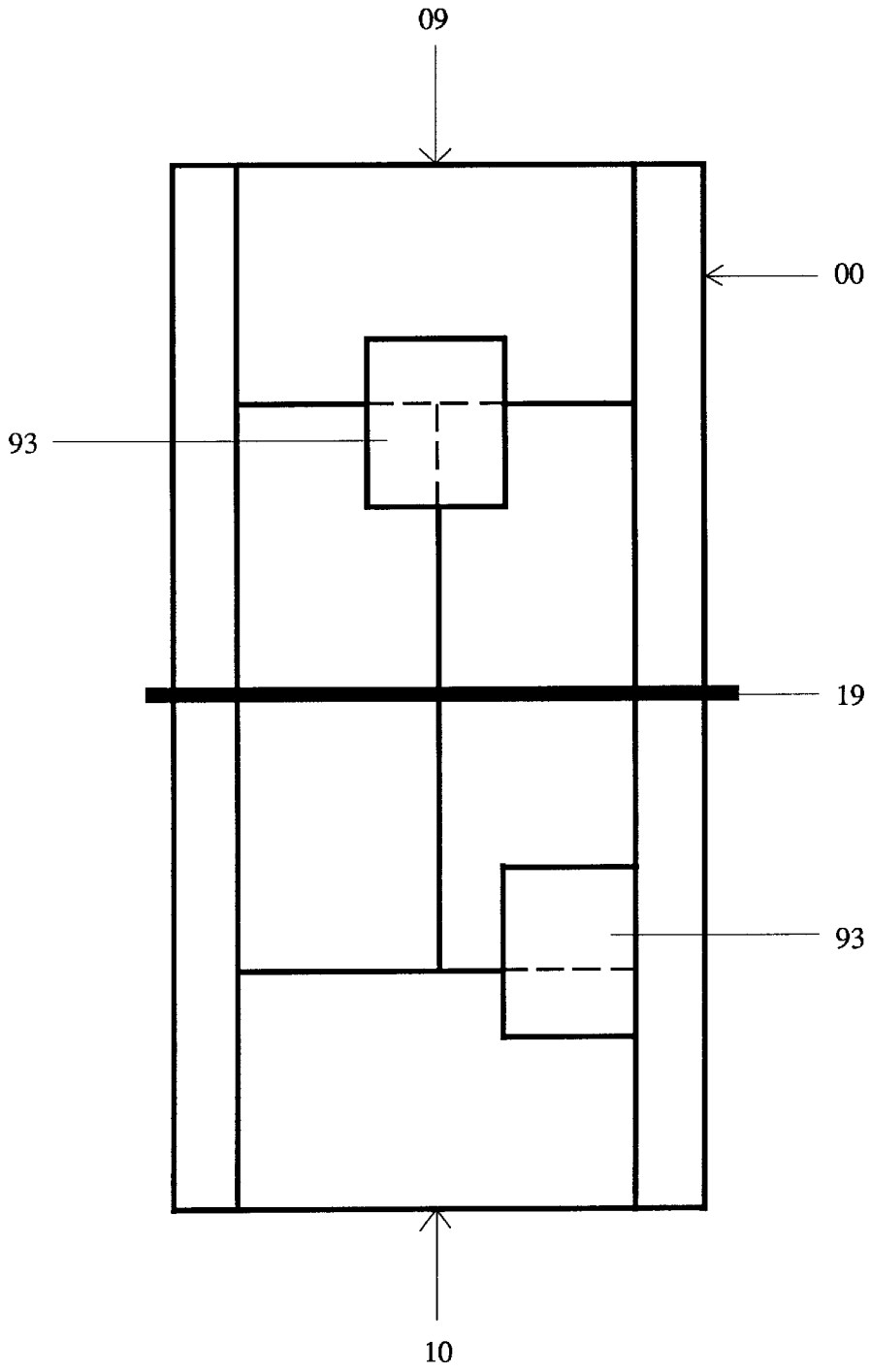

FIG. 3*g* Alternate Target Side Singles Placement "Off Key" Example

Figure 3H:
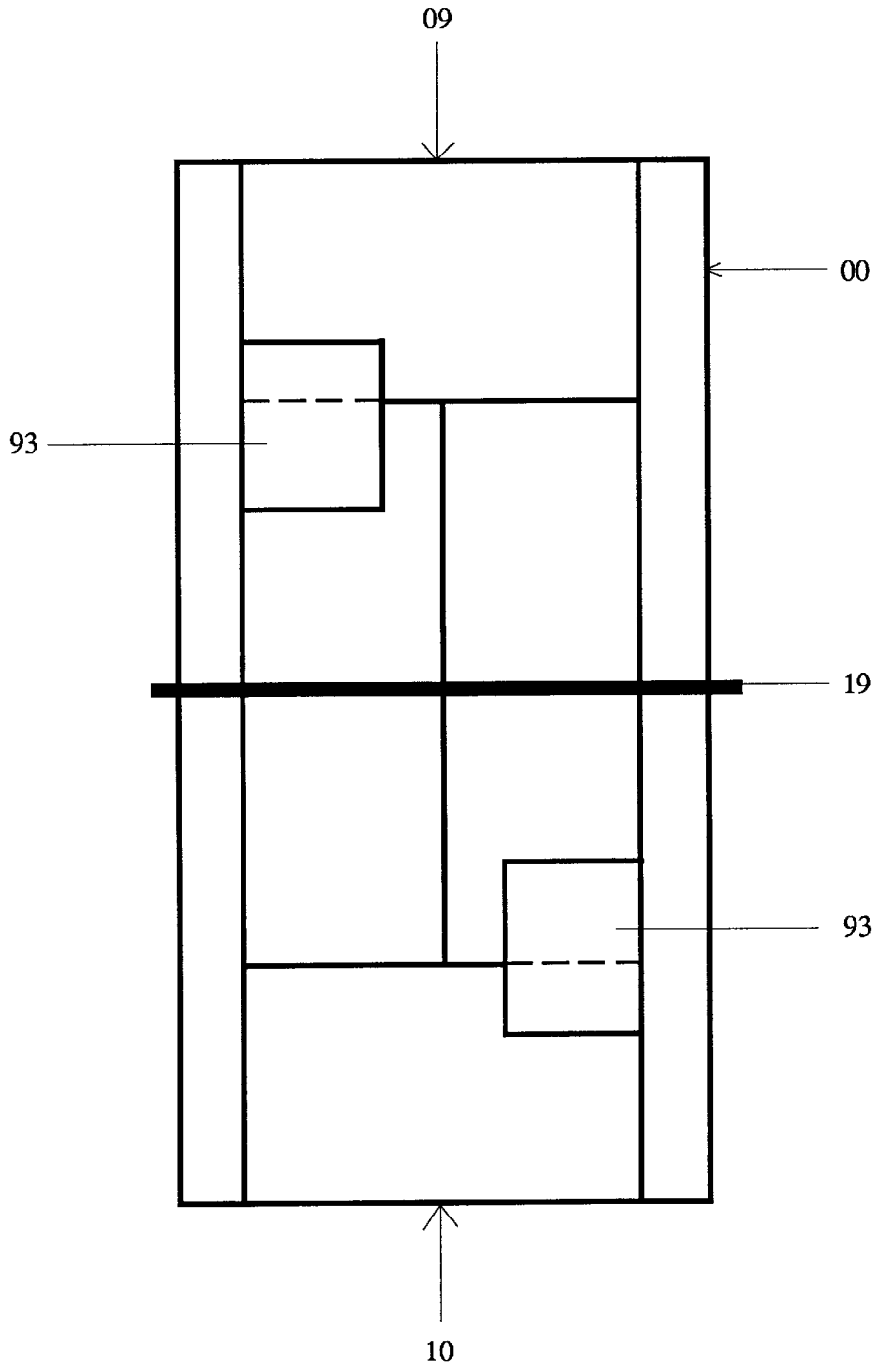

FIG. 3*h* Alternate Both Sides Singles Placement "Off Key" Example

Figure 4A:
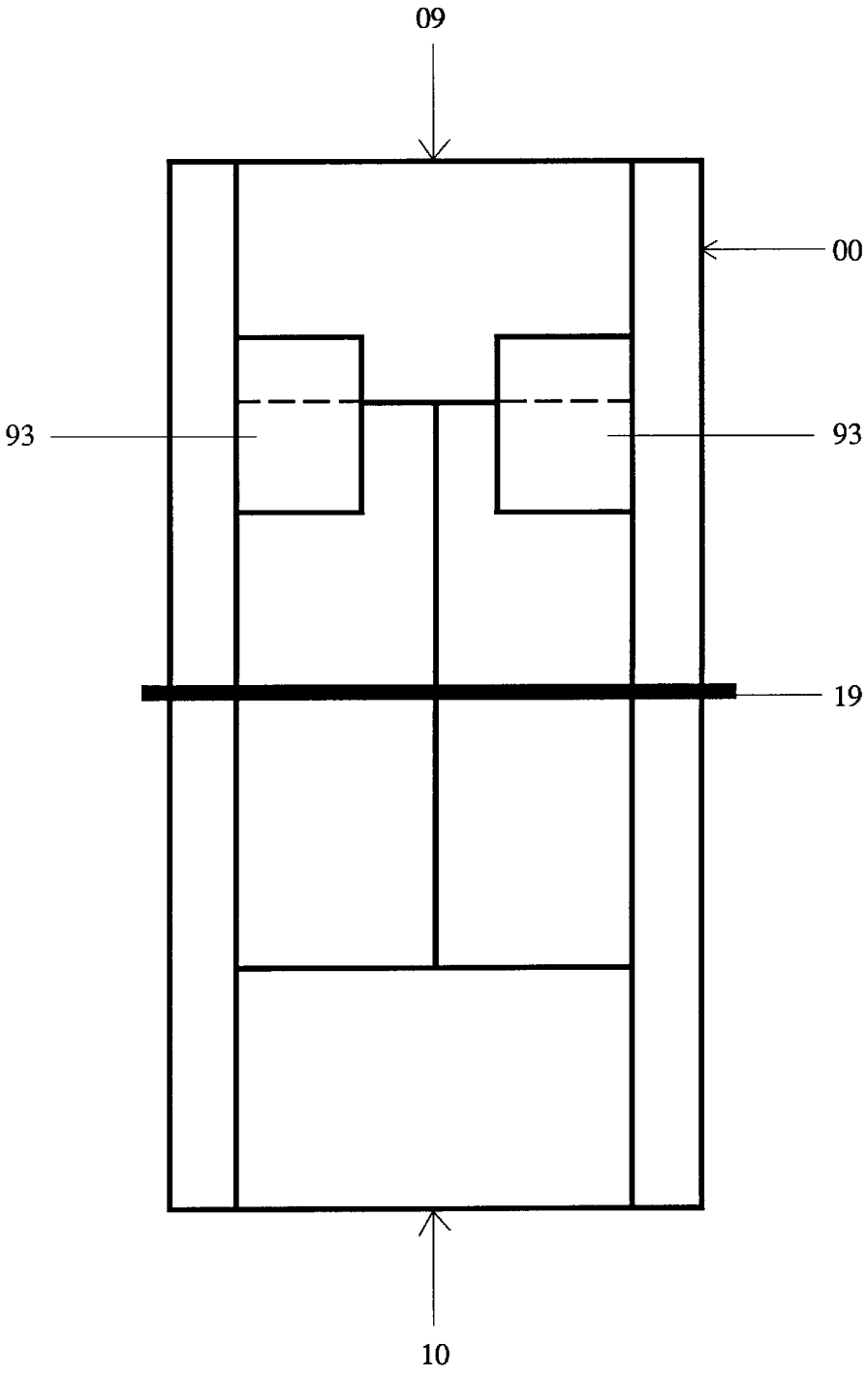
Figure 4B:
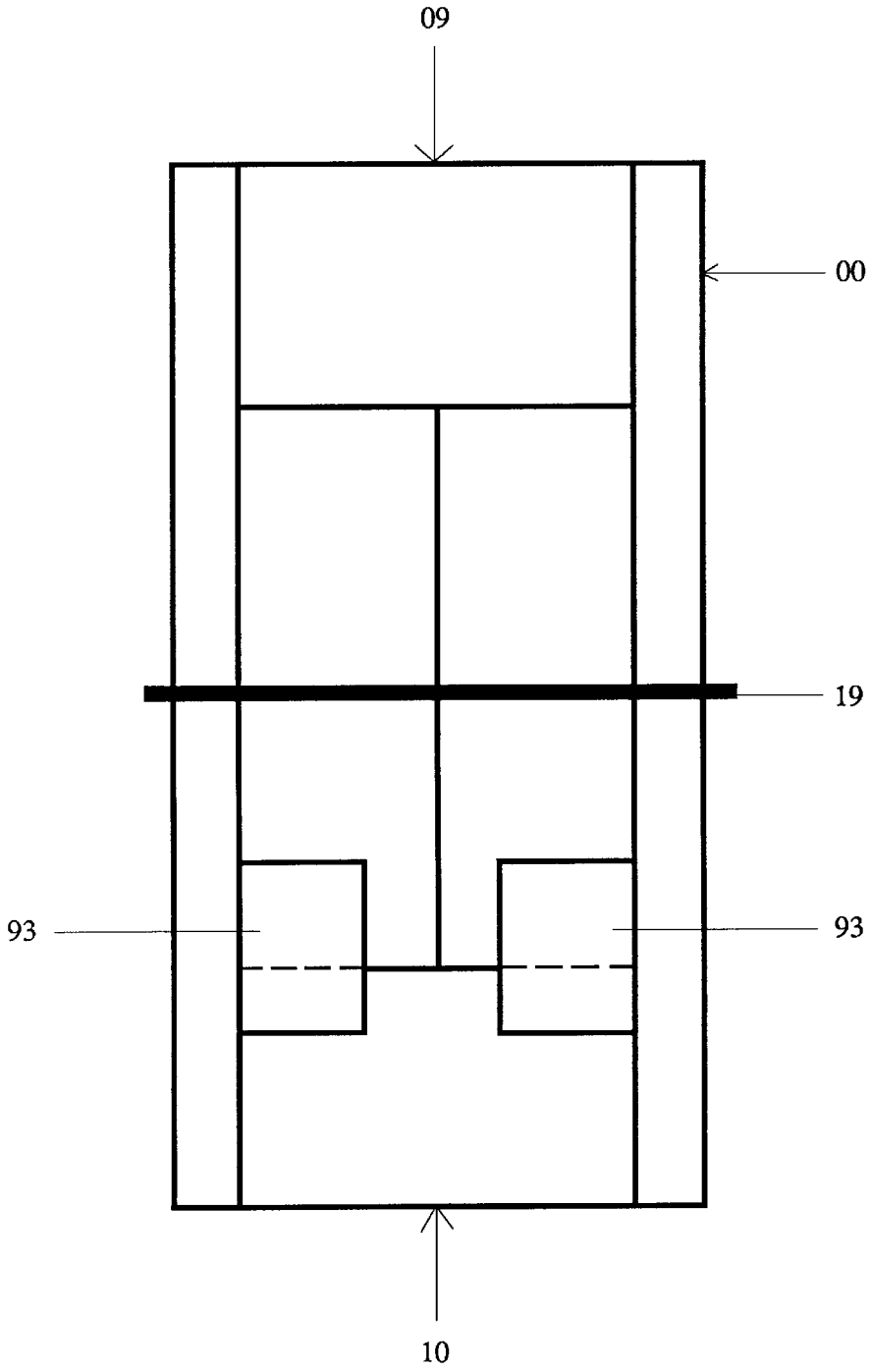
Figure 4C:
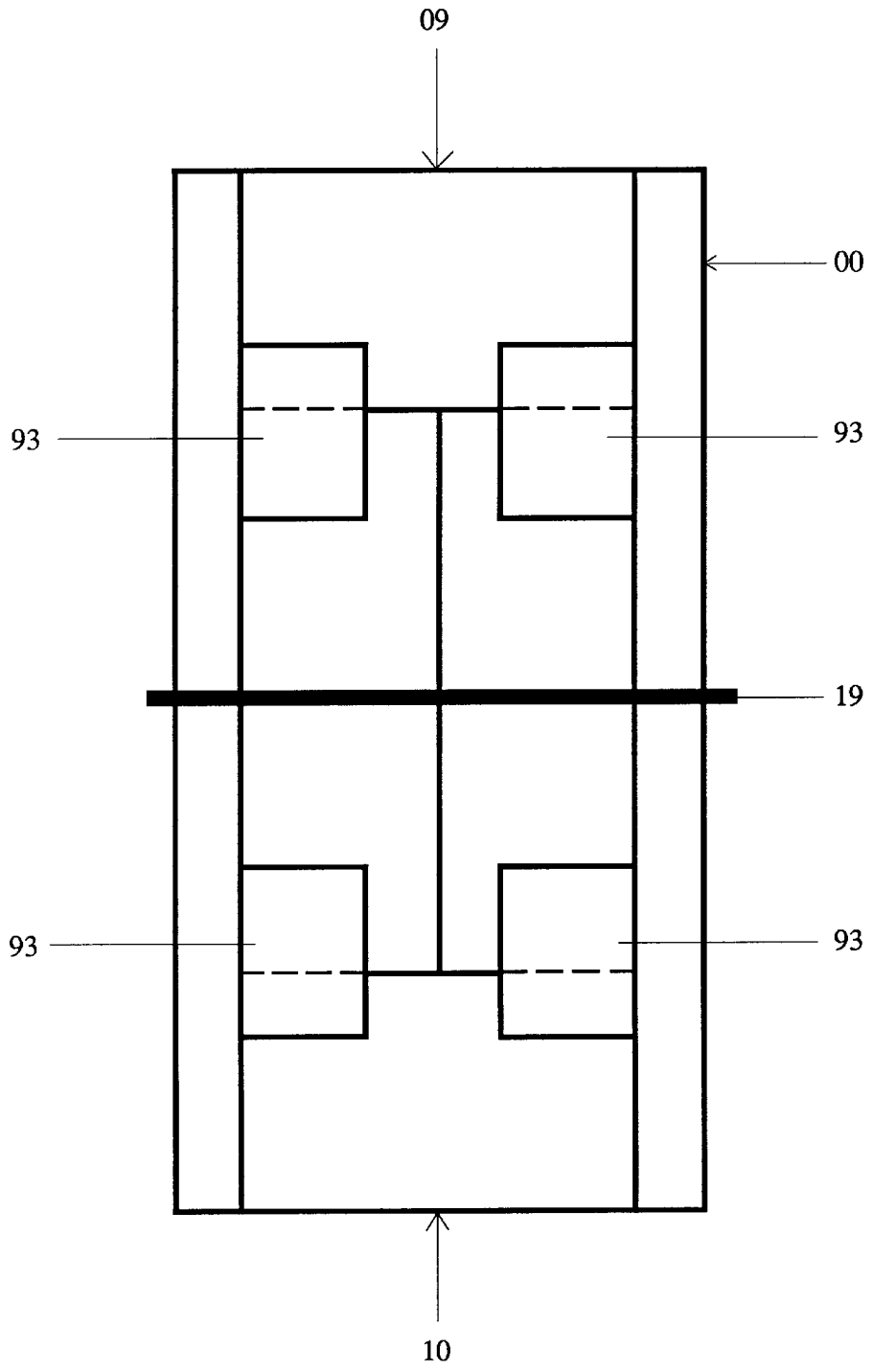
Figure 4D:
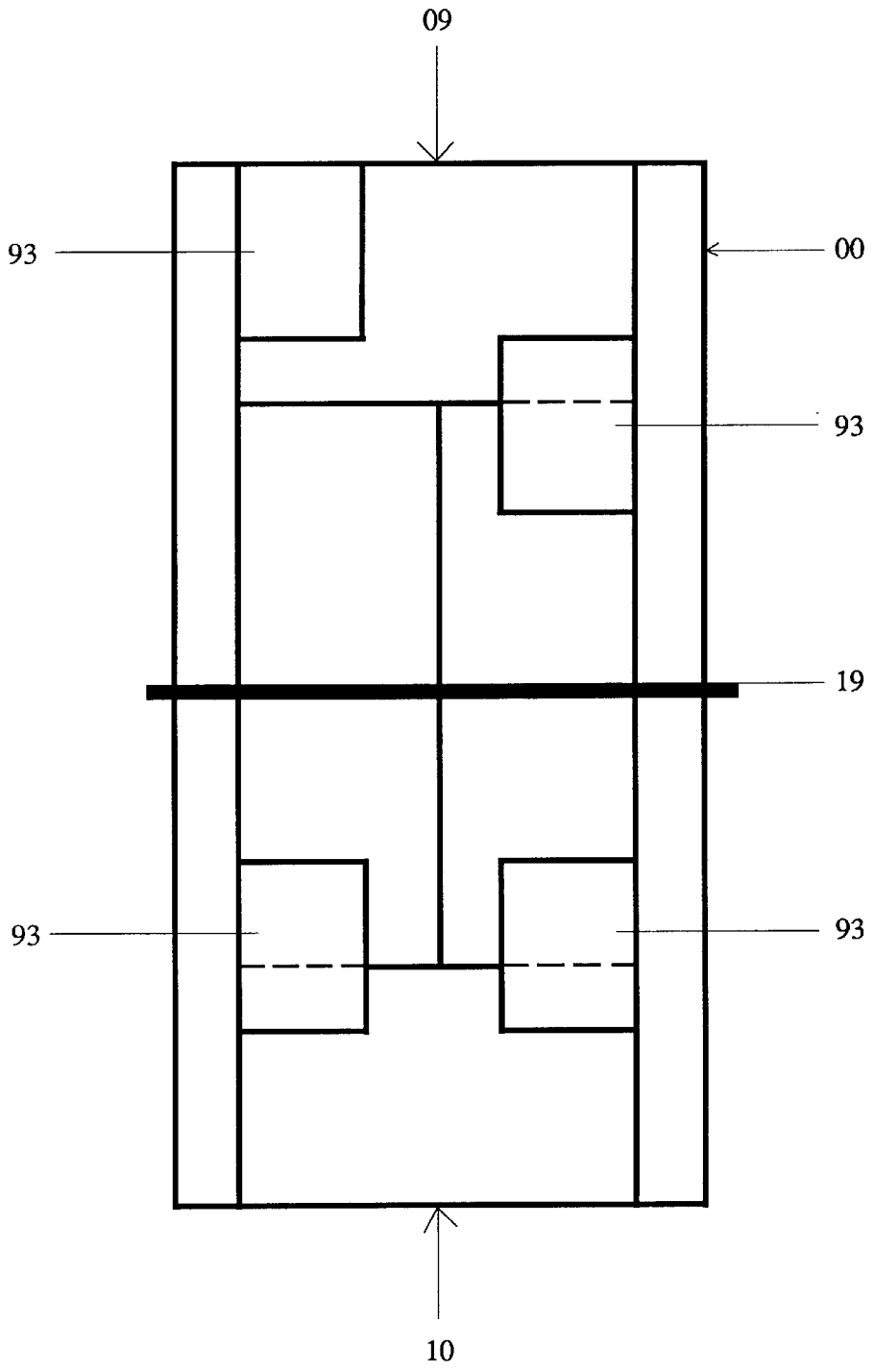
Figure 4E:
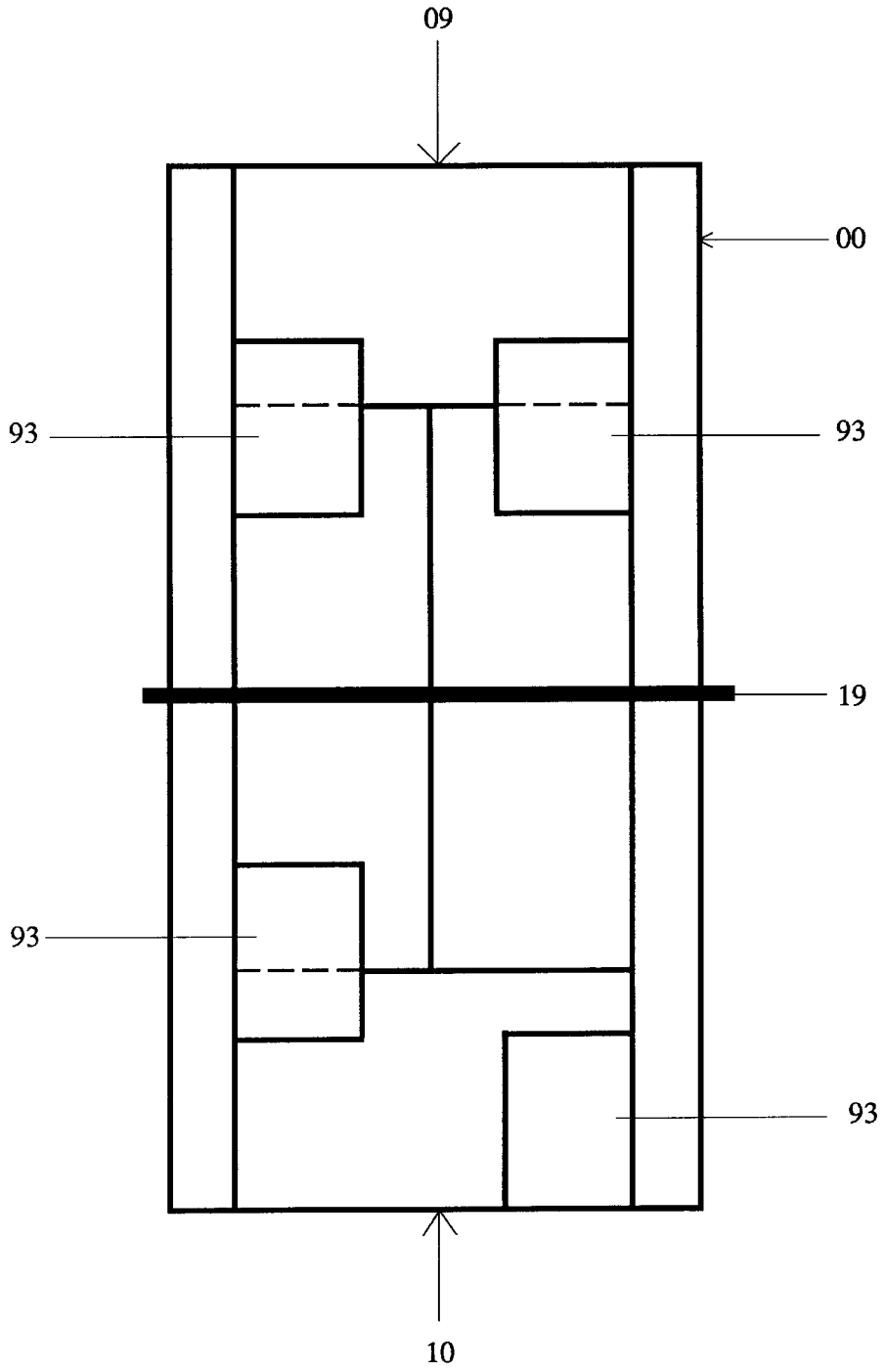
Figure 4F:
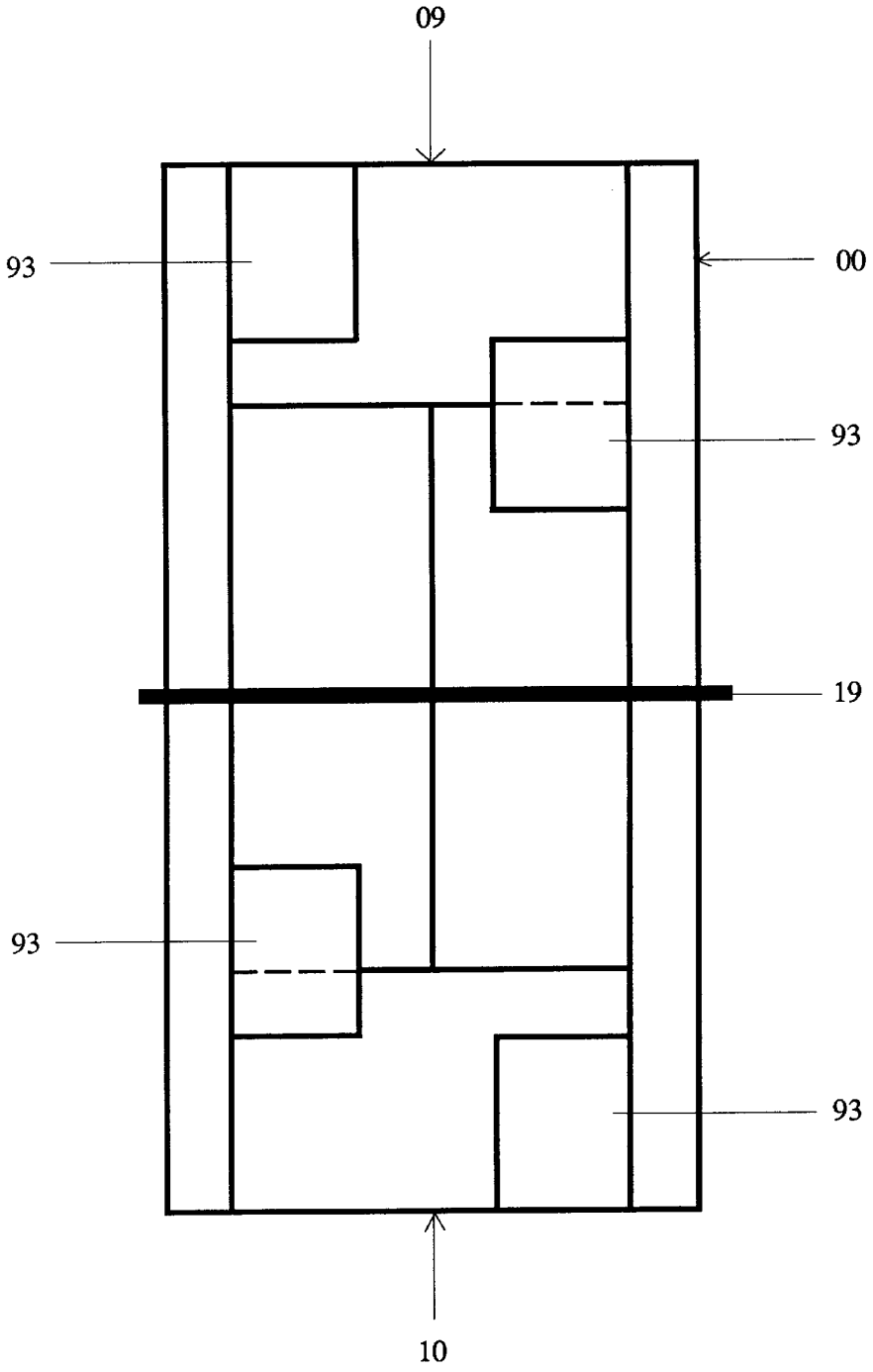
Figure 4G:
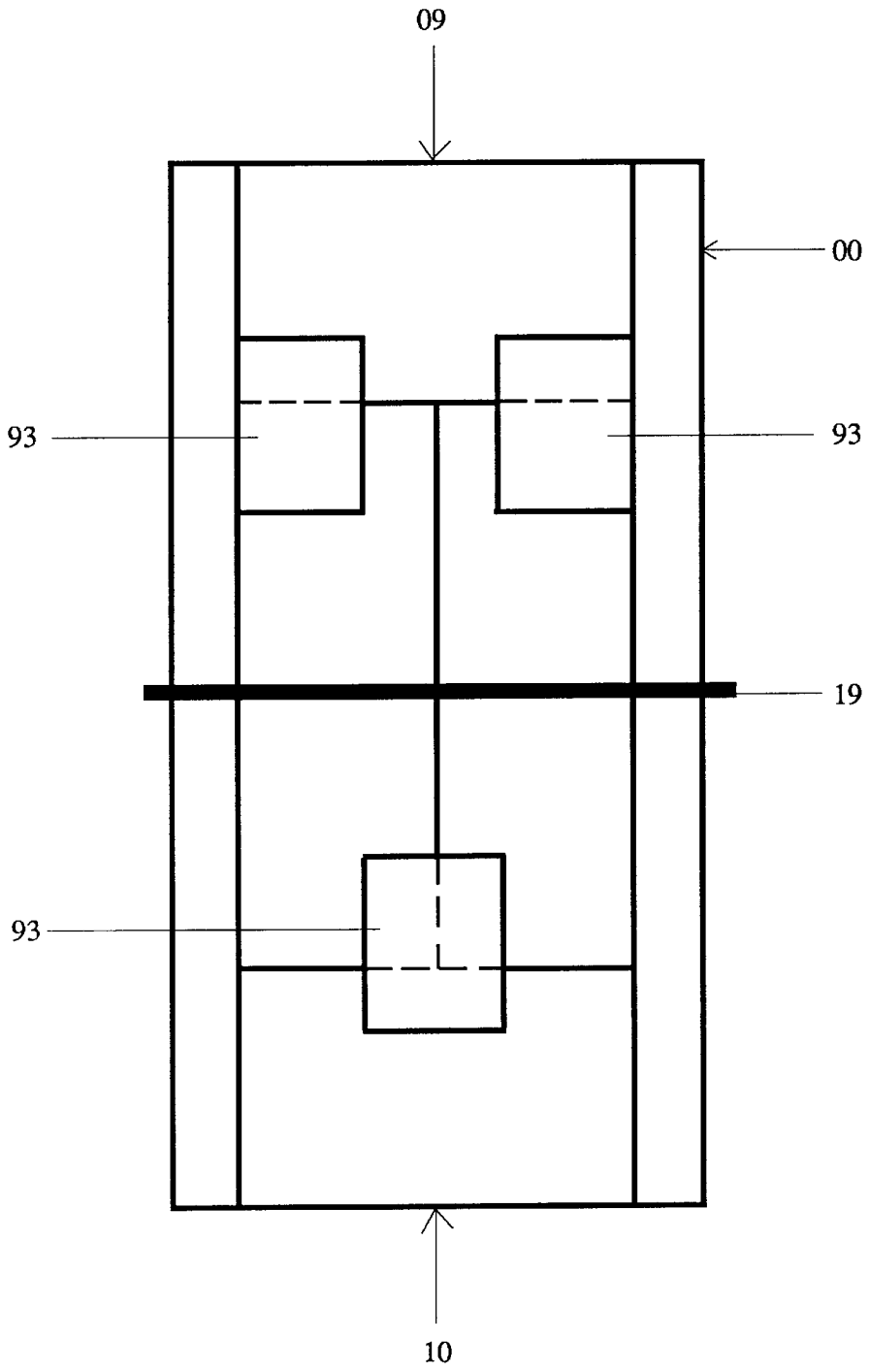

FIGS. 4*a*–4*h* Sector-Size Playing Surface Tennis Court Trainer, Doubles Placement FIG. 4*a* Player Side Doubles Placement Example FIG. 4*b* Target Side Doubles Placement Example FIG. 4*c* Standard Doubles Placement FIG. 4*d* Alternate Player Side Doubles Placement Example FIG. 4*e* Alternate Target Side Doubles Placement Example FIG. 4*f* Alternate Both Sides Doubles Placement Example FIG. 4*g* Two-On-One Placement Example (Doubles and Singles Combined)

Figure 4H:
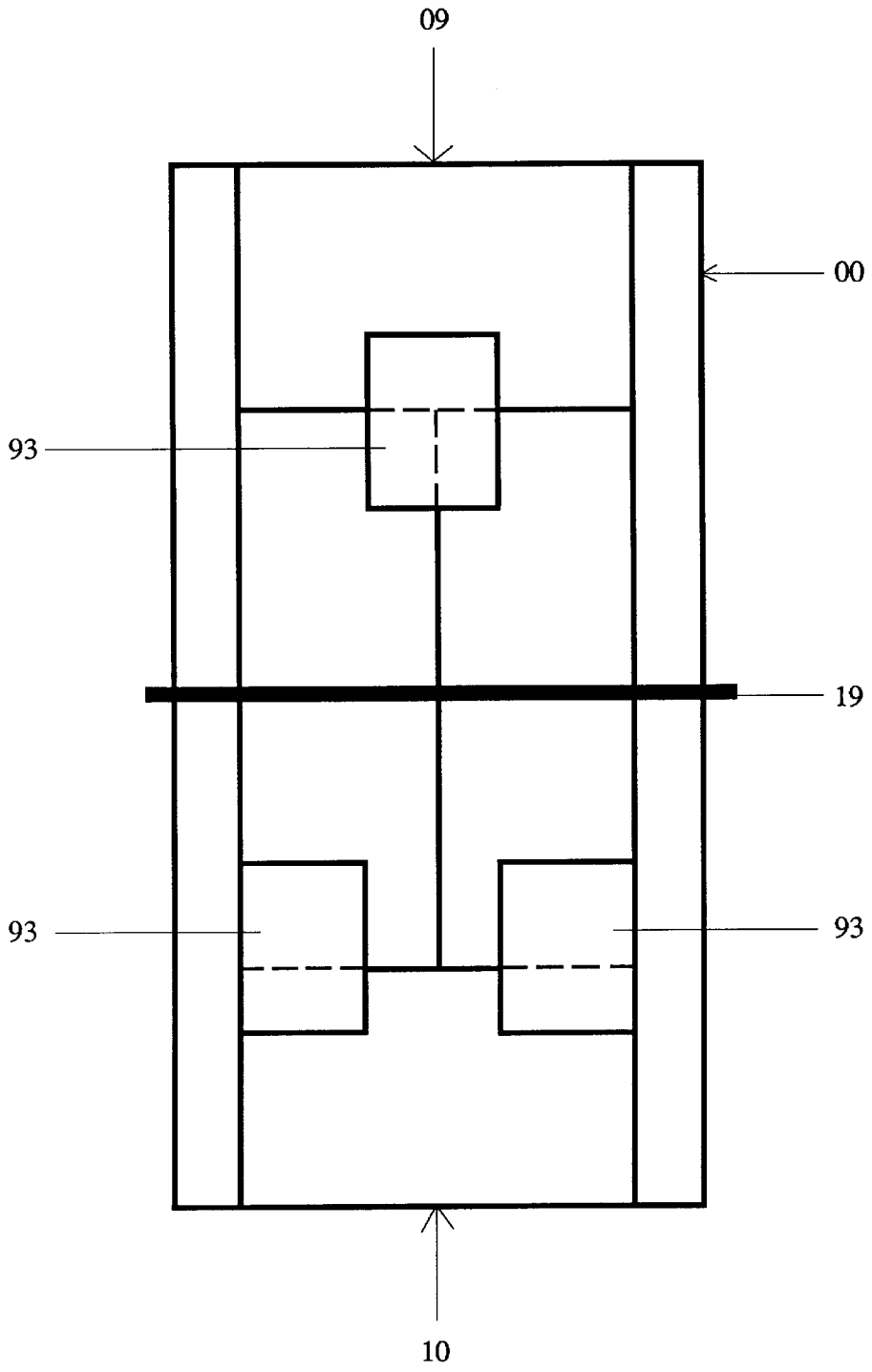

FIG. 4*h* One-On-Two Placement Example (Singles and Doubles Combined)

Figure 5A:
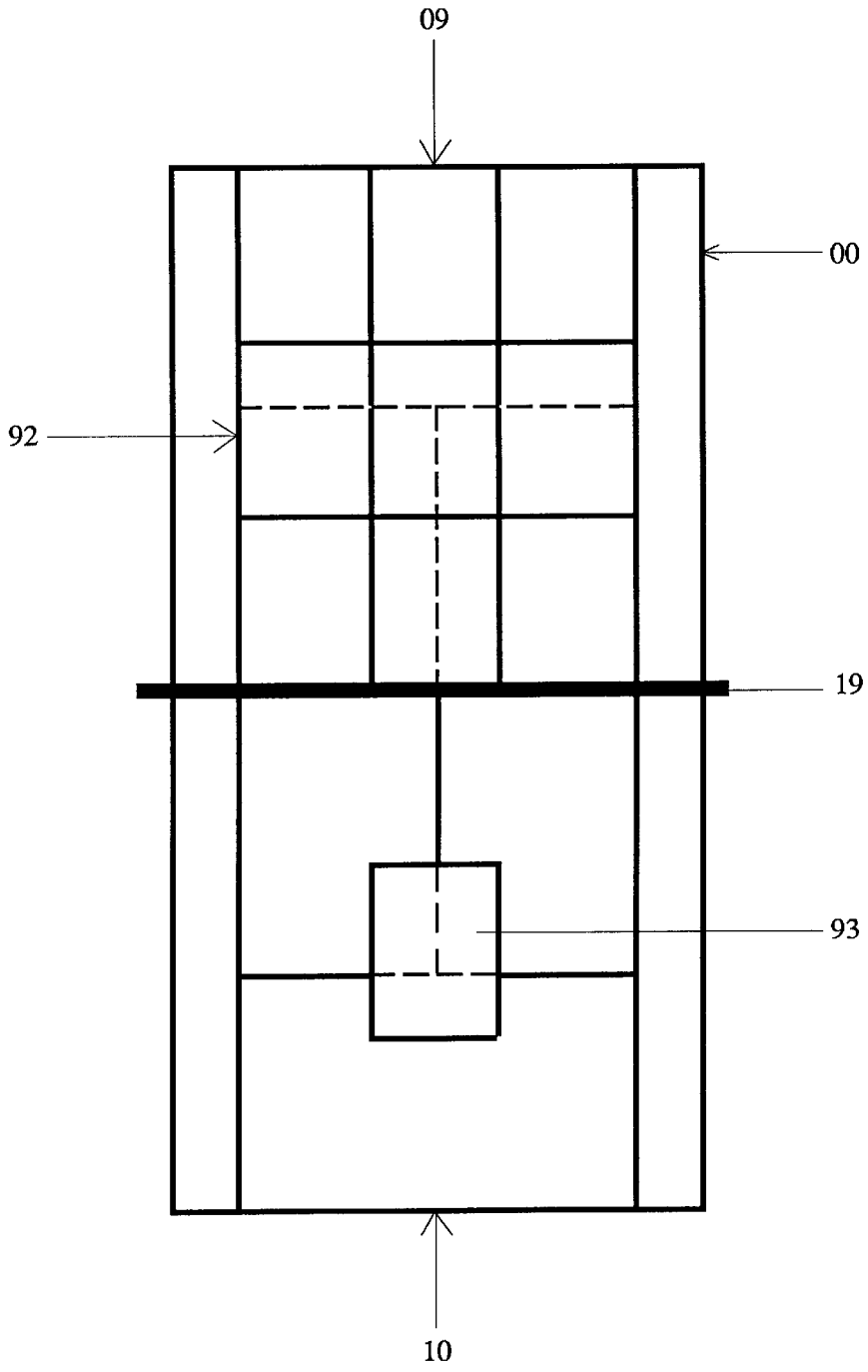
Figure 5B:
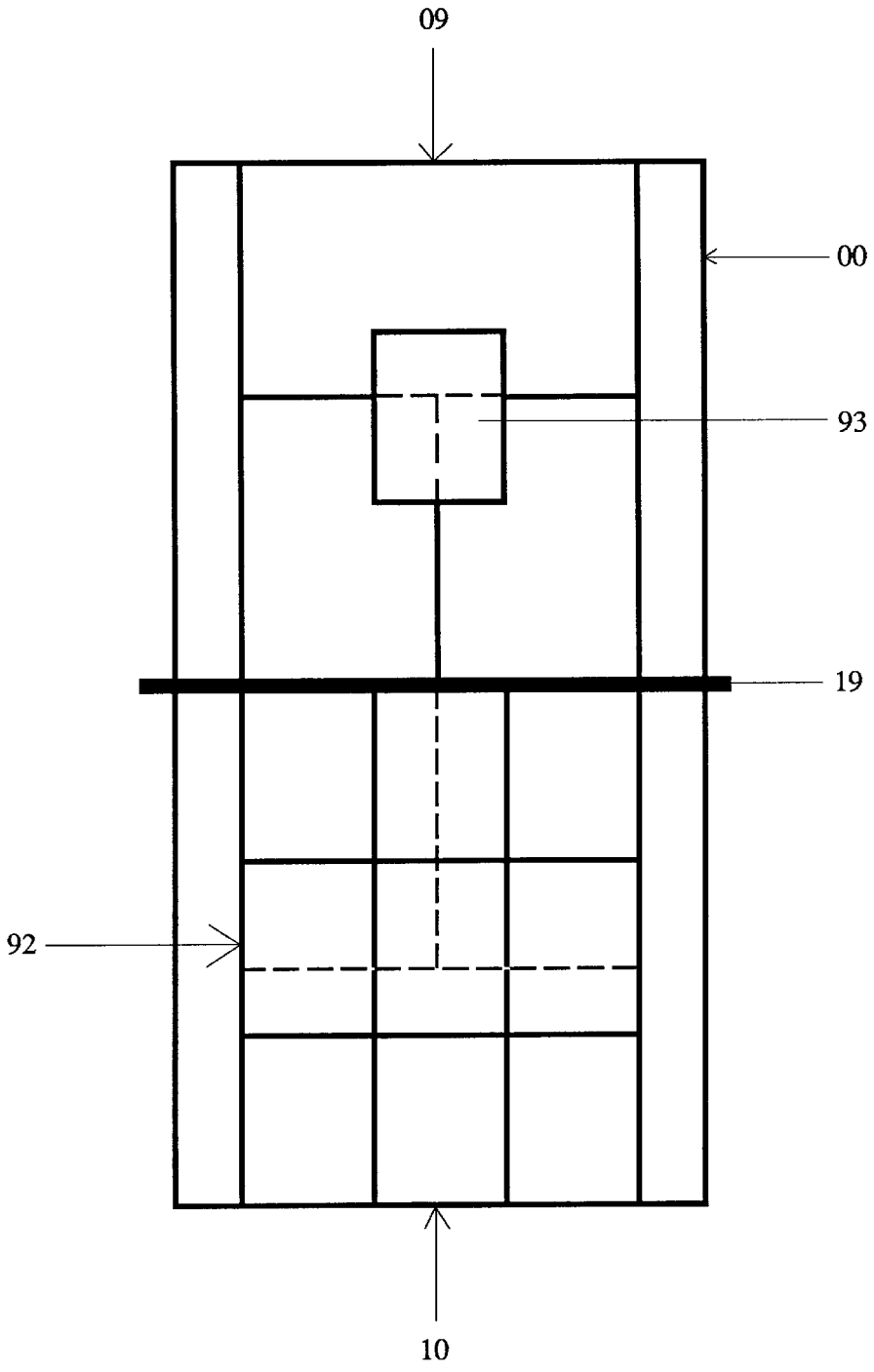
Figure 5C:
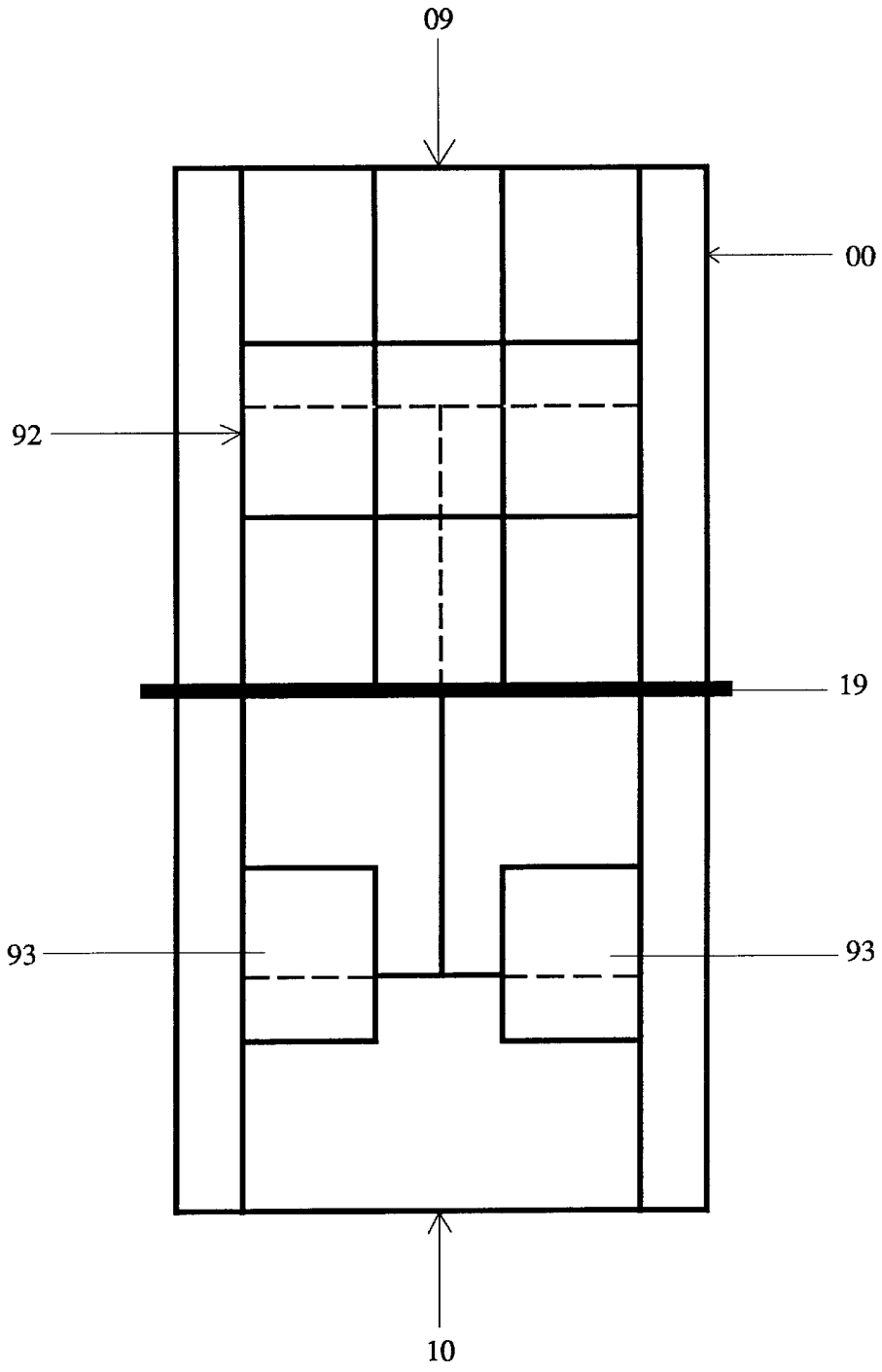
Figure 5D:
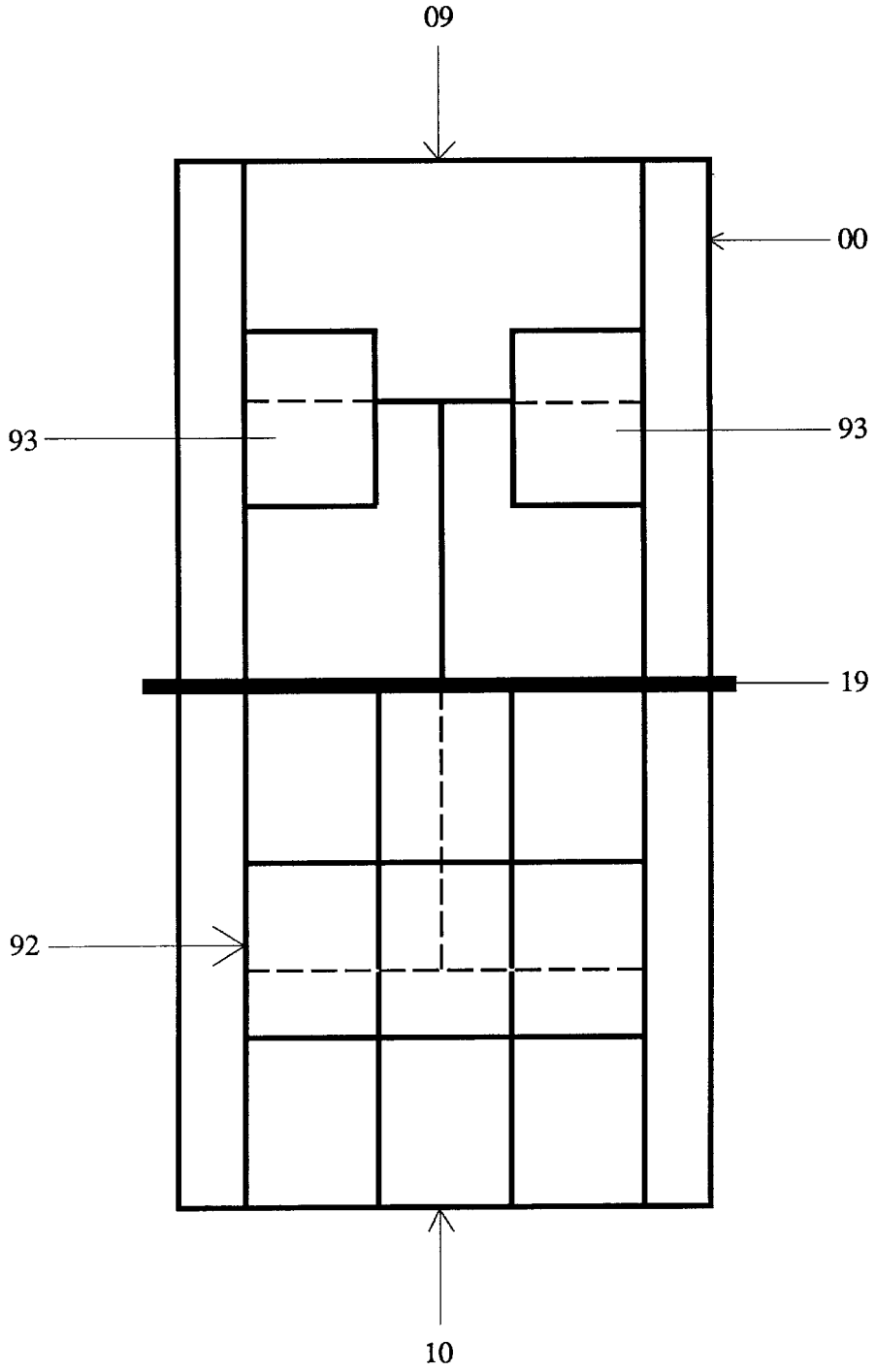
Figure 6:
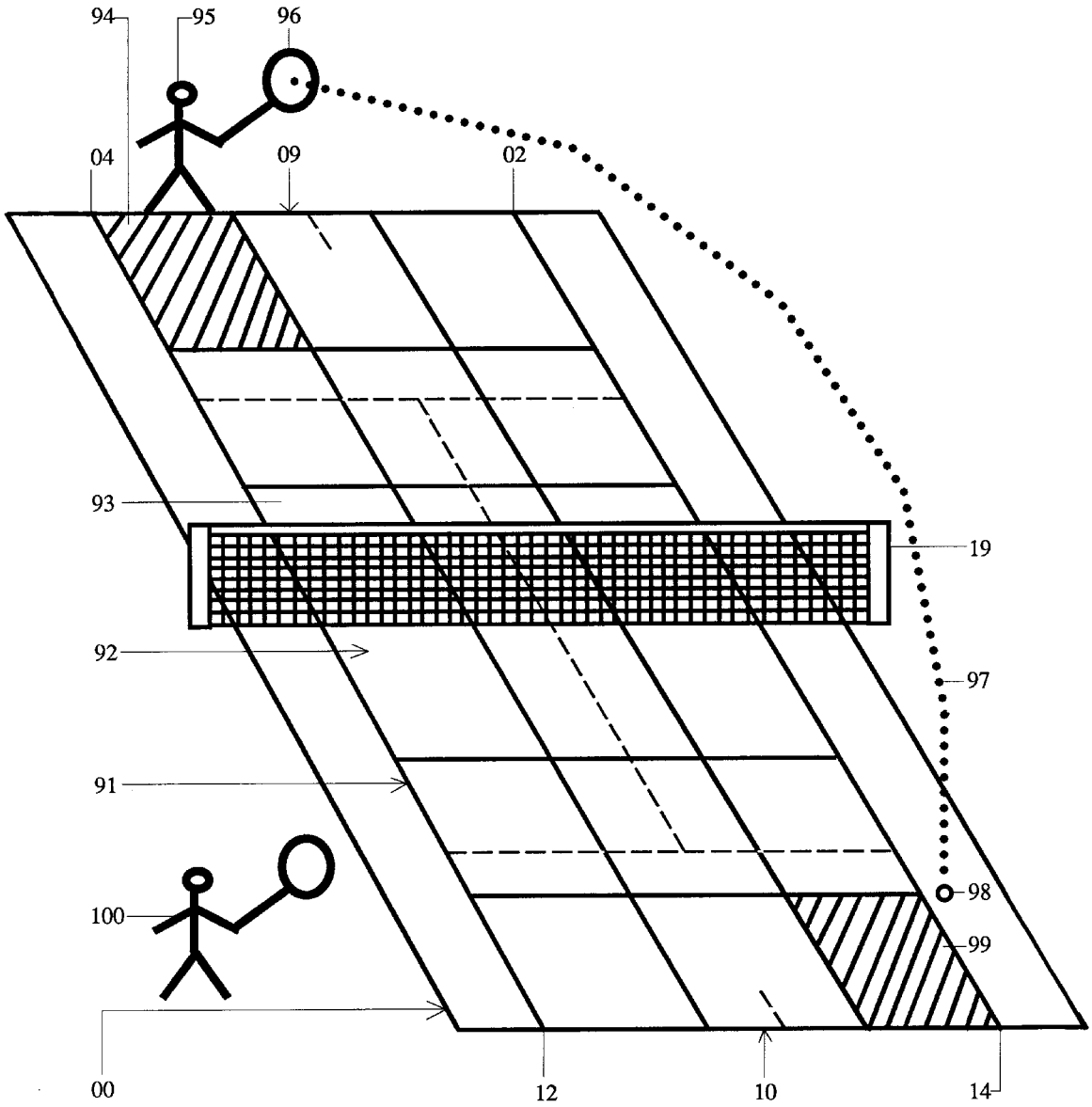

FIGS. 5*a*–5*d* Combined Half-Size and Sector-Size Playing Surface Tennis Court Trainers FIG. 5*a* Singles Player Side FIG. 5*b* Singles Target Side FIG. 5*c* Doubles Player Side FIG. 5*d* Doubles Target Side FIG. 6 Perspective Action-View Model of Tennis Court Trainer (91–100)

Figure 7A:
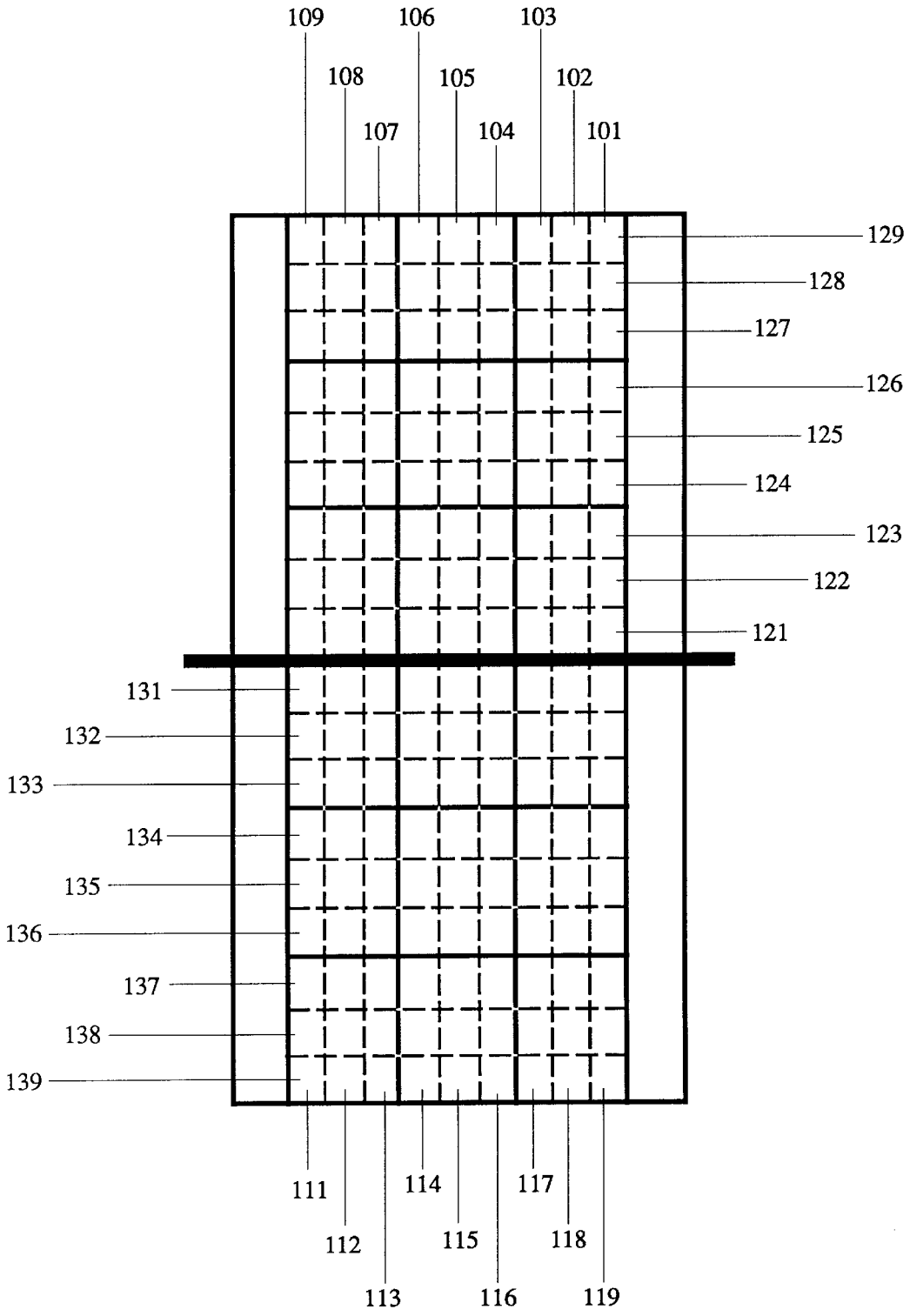
Figure 7B:
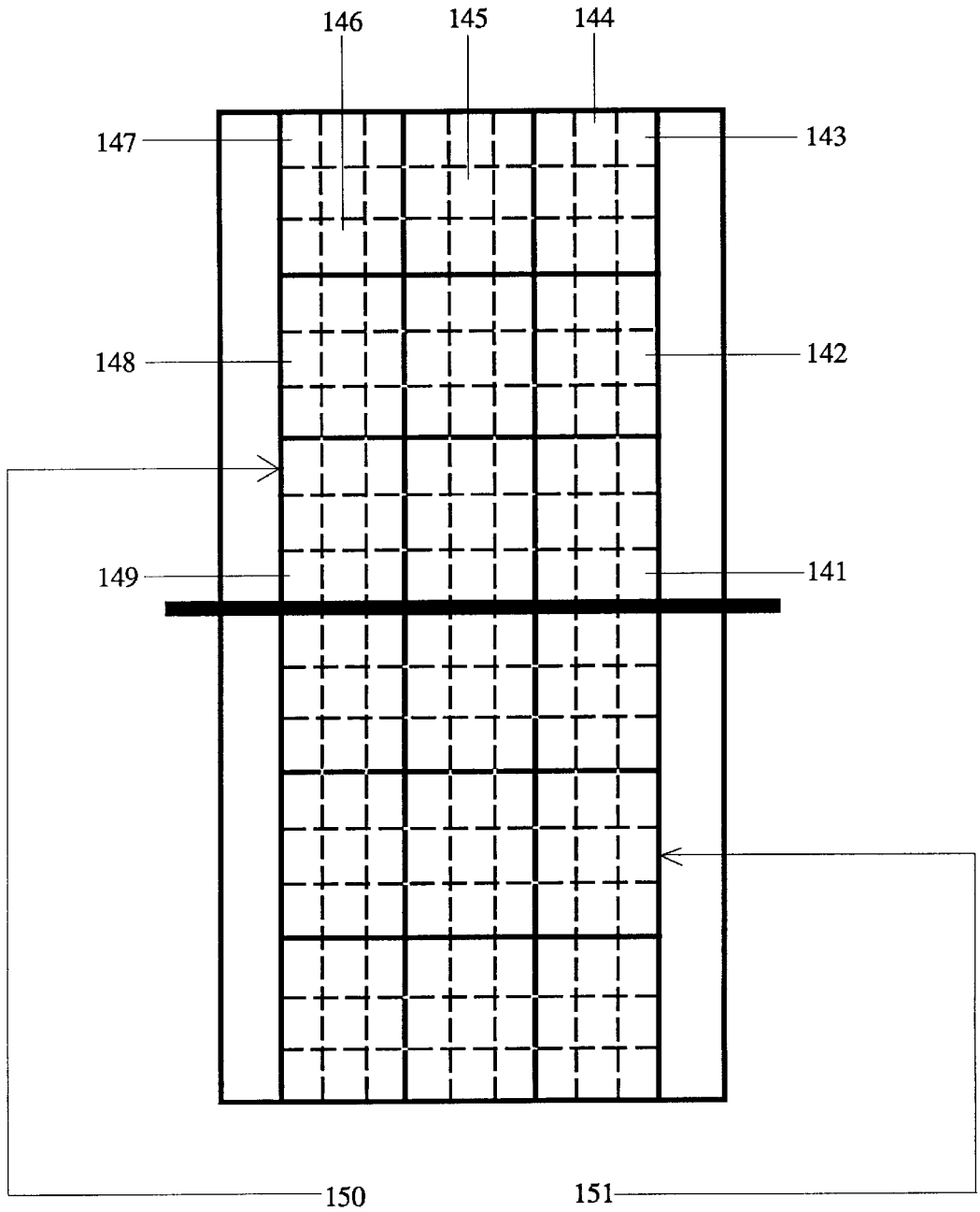

FIGS. 7*a*–7*b* Sub & Super Sector Components of The Invention (101–151)

FIG. 7*a* Sublanes (101–109 and 111–119) and Subzones (121–129 and 131–139)

FIG. 7*b* Subsectors (141–149) and Supersectors (150–151)

REFERENCE NUMERALS IN DRAWINGS:

00 The Playing Surface of a Tennis Court (includes all Numerals 01–18, but not 19)

00–09 Lines of Court, Player Side (FIG. 0*a*)

01 Doubles Side Line, left side

02 Singles Side Line, left side

03 Center Mark (also known as Center Stripe)

04 Singles Side Line, right side

05 Doubles Side Line, right side

06 Base Line

07 Service Line

08 Center Line

09 Player Side of court (includes all Reference Numerals 01–08)

10–18 Lines of Court, Target Side (FIG. 0*a*)

10 Target Side of court (includes all Reference Numerals 11–18)

11 Doubles Side Line, left side

12 Singles Side Line, left side

13 Center Mark (also known as Center Stripe)

14 Singles Side Line, right side

15 Doubles Side Line, right side

16 Base Line

17 Service Line

18 Center Line

19 Net

20–30 Areas of Court, Horizontal (FIG. 0*b*)

20 Service Box, left side (Player Side)

21 Service Box, right side (")

22 Backcourt (Physical View)

23 Forecourt (")

24 Forecourt (Logical View)

25 Midcourt (")

26 Backcourt (")

27 Alley 1 of 2 (both sides of court)

28 Service Box, left side (Target Side)

29 Service Box, right side (")

30 Alley 2 of 2 (both sides of court)

31–40 Areas of Court, Vertical (FIG. 0*c*)

31 Left Side of court, Player Side (Physical View)

32 Right Side of court, Player Side (")

33 Player Location from which ball is hit (Logical View, right side)

34 "Down The Line" Target Location (")

35 "Down The Middle" Target Location (")

36 "Cross Court" Target Location (")

37 Player Location from which ball is hit (Logical View, left side)

38 "Down The Line" Target Location (")

39 "Down The Middle" Target Location (")

40 "Cross Court" Target Location (")

41–46 Lanes of Tennis Court Trainer (FIG. 1*a*)

41 Left Lane (Player Side)

42 Center Lane (")

43 Right Lane (")

44 Left Lane (Target Side)

45 Center Lane (")

46 Right Lane (")

51–56 Zones of Tennis Court Trainer (FIG. 1*a*)

50 Net Line (FIG. 1*c*)

51 Front Zone (Player Side)

52 Middle Zone (")

53 Back Zone (")

54 Front Zone (Target Side)

55 Middle Zone (")

56 Back Zone (")

61–69 Sectors of Tennis Court Trainer, Player Side (FIG. 1*b*)

61 Left-Front Corner Sector

62 Left Side Sector

63 Left-Back Corner Sector

64 Back Side Sector

65 Center Sector ("The Key" location)

66 Front Side Sector

67 Right-Back Corner Sector

68 Right Side Sector

69 Right-Front Corner Sector

71–79 Sectors of Tennis Court Trainer, Target Side (FIG. 1*b*)

71 Left-Front Corner Sector

72 Left Side Sector

73 Left-Back Corner Sector

74 Back Side Sector

75 Center Sector ("The Key" location)

76 Front Side Sector

77 Right-Back Corner Sector

78 Right Side Sector

79 Right-Front Corner Sector

80–90 Functionary References (FIGS. 0*b*–0*c*)

80 Imaginary line dividing numerals 22 and 23, right side (FIG. 0*b*)

81 Imaginary line dividing numerals 22 and 23, left side (")

82 Imaginary line dividing numerals 24 and 25 (")

83 Imaginary line dividing numerals 25 and 26 (")

84 Imaginary line dividing numerals 31 and 32 (FIG. 0*c*)

85 Direction of shot from numerals 33 to 34 (")

86 Direction of shot from numerals 33 to 35 (")

87 Direction of shot from numerals 33 to 36 (")

88 Direction of shot from numerals 37 to 38 (")

89 Direction of shot from numerals 37 to 39 (")

90 Direction of shot from numerals 37 to 40 (")

91–100 Basic Elements of Tennis Court Trainer (FIG. 6)

91 Full-Size Playing Surface (occupies all nine sector locations on both sides of court)

92 Half-Size Playing Surface (occupies all nine sector locations on either side of court)

93 Sector-Size Playing Surface (occupies any of the nine sector locations on either side ")

94 Player Sector (any sector on Player Side of court from which shot of ball is hit)

95 Tennis Player

96 Tennis Racket

97 Shot of ball, hit from Player Sector (94) to Target Sector (99)

98 Tennis Ball

99 Target Sector (any sector on Target Side of court to which shot of ball is aimed)

100 Tennis Partner (optional, not required)

101–109 Sublanes Player Side (FIG. 7*a*)

101 Left Sublane of Left Lane

102 Center Sublane "

103 Right Sublane "

104 Left Sublane of Center Lane

105 Center Sublane "

106 Right Sublane "

107 Left Sublane of Right Lane

108 Center Sublane "

109 Right Sublane "

111–119 Sublanes Target Side (FIG. 7*a*)

111 Left Sublane of Left Lane

112 Center Sublane "

113 Right Sublane "

114 Left Sublane of Center Lane

115 Center Sublane "

116 Right Sublane "

117 Left Sublane of Right Lane

118 Center Sublane "

119 Right Sublane "

121–129 Subzones Player Side (FIG. 7*a*)

121 Front Subzone of Front Zone

122 Middle Subzone

123 Back Subzone "

124 Front Subzone of Middle Zone

125 Middle Subzone "

126 Back Subzone "

127 Front Subzone of Back Zone

128 Middle Subzone "

129 Back Subzone "

131–139 Subzones Target Side (FIG. 7*a*)

131 Front Subzone of Front Zone

132 Middle Subzone "

133 Back Subzone "

134 Front Subzone of Middle Zone

135 Middle Subzone "

136 Back Subzone "

137 Front Subzone of Back Zone

138 Middle Subzone "

139 Back Subzone "

141–149 Subsector Components of The Invention (FIG. 7*b*)

141 Left-Front Corner Subsector

142 Left Side Subsector

143 Left-Back Corner Subsector

144 Back Side Subsector

145 Center Subsector

146 Front Side Subsector

147 Right-Back Corner Subsector

148 Right Side Subsector

149 Right-Front Corner Subsector

150–151 Supersector Components of The Invention (FIG. 7*b*)

150 Player Side Supersector

151 Target Side Supersector

Unused Reference Numerals (12 out of 152 including 00): 47–49, 57–60, 70; 110, 120, 130, 140

TABLE OF CONTENTS

A. Preface
Field of The Invention
Drawing FIGS.
Reference Numerals
Table of Contents
B. Background of The Prior Art: (FIGS. 0*a*–0*c*)
Traditional Practice
(Introduction, First Method, Second Method, Third Method, Conclusion)
Traditional Theory
(Introduction, Physical View, Logical View Horizontal Aspect, Logical View Vertical Aspect, Summary)
C. Objects and Advantages: (FIGS. 1*a*–1*c*)
D. Description of The Invention: (FIGS. 1*c*, 2*a*–2*d*, 3*a*–3*b*)
Surfaces
(Introduction, Full-Size Playing Surface Model, Half-Size Playing Surface Model, Sector-Size Playing Surface Model, Conclusion)
Substances
(Introduction, Durability, Portability, Storability, Bounce, Conclusion)
E. Operation of The Invention: (FIGS. 1*d*, 2*e*–2*f*, 3*c*–3*h*, 4*a*–4*f*, 5*a*–5*d*, 6)
Placement
(Introduction, Full-Size Playing Surface Model, Half-Size Playing Surface Model, Sector-Size Playing Surface Model, Conclusion)
Practice
(Introduction, Player Side of Court, Target Side of Court, Player Side and Target Side Combined, Stages of Practice, Conclusion)
F. Summary, Ramifications, and Scope: (FIGS. 7*a*–7*b*)
Benefits
(Introduction, Accuracy, Communications, Understanding, Marketability, Conclusion)
Glossary of Terms (Technical Definitions)
G. Claims
H. Abstract

BACKGROUND OF THE PRIOR ART: (FIGS. 0*a*–0*c*)

Traditional Practice

Introduction. Eversince the sport of tennis was invented over one-hundred years ago, players have practiced in order to improve the accuracy of their shots since this is the very object of the game. And indeed, the way to win. And anything that helps a player practice better will naturally help him play better in actual competition. Currently, accuracy is developed using three basic methods.

First Method. The first method is to practice hitting the ball employing various "strokes" such as serve, volley, forehand, backhand, lob, and drive using various "grips" on the racket. This method, however, concentrates on HOW a player uses a racket to hit the ball. It does not directly improve accuracy though, because WHERE the ball is hit is not the primary and foremost objective and the actual result really improves "form" more than it does "placement" (i.e. accuracy).

Second Method. The second method is to use some sort of vertical surface structure which is positioned perpendicular to (as opposed to, parallel with) the playing surface of a court. This is either a wall or a backboard against which a ball is hit. But because this method relies on the vertical dimension, it cannot possibly improve accuracy in a direct way either, since distance on a court isn't vertical but horizontal in nature. Even when targets are put on the vertical face, their presence is irrelevant since they don't represent actual, authentic, locations. This method actually hinders improving accuracy (i.e. "placement") because horizontal distance is barricaded by an intervening vertical partition.

Third Method. The third method is to place an object of some kind someplace on the court which serves as a target against which a ball can be aimed Up until now, only things such as racket head covers, towels, ball containers, ball container covers, and anything else at hand served this purpose. The problem with all of these, however, is that they are forced to serve a function for which they were not specifically designed and intended. Also, most of the objects used are much too small to hit even once—let alone consistently—even by professional players who have developed a notable degree of accuracy already. Furthermore, all of these objects are used in the same arbitrary fashion without any conscious regard for size, shape, and placement of the object employed; and therefore, cannot possibly improve accuracy effectively by that very fact.

Conclusion. No one, to the best of my knowledge and experience, has come up with a direct solution for this century-old problem of improving accuracy effectively, heretofore.

Traditional Theory

Introduction. A much more direct and effective way for improving accuracy has escaped the world of tennis because of the traditional way of viewing a tennis court; and, the terminology which has evolved to reinforce that view which effectively prevents looking at things in any other way than the traditional one. What follows next is a description of how the traditional approach sees things, and refers to them, from a physical and a logical standpoint. As all figures are of the same invention, reference numerals not directly related to the particular point being illustrated are not repeated so as to make it more apparent by not obscuring the point being made.

Physical View. As seen in FIG. 0*a* from above, when looking at the playing surface of a tennis court 00 we see that there are two sides 09 and 10, one on either side of the net 19. When looking at either side, the naked eye sees only the following areas because the lines on the court physically delineate them and make their existence present.

The outside perimeter is formed by the doubles side lines 01 & 05 and 11 & 15 on the sides, the base lines 06 and 16 in the back, and the net 19 in the front. This area is internally sectioned off vertically by the singles side lines 02 & 04 and 2 & 14, and horizontally by the service lines 07 and 17, and then vertically once more by the center lines 08 and 18 with center marks 03 and 13 dividing the base lines in half. As seen in FIG. 0*b,* the service line divides the court horizontally into two nearly equal halves, commonly referred to as: back 22 (18 feet long) and front 23 (21 feet long). The front half is further divided vertically into two exactly equal halves called service boxes: left 20 and 28 and right 21 and 29 (each 13.5 feet wide).

Notice that horizontally speaking, there is no real 'middle' area at all (except for the service line itself which separates front from back). Notice also that vertically speaking, there is no real 'middle' area either as such (except for the center lines and center marks which separates left from right).

The two areas formed by the distances between the doubles side lines and the singles side lines called "alleys" 27 and 30 are considered only when playing doubles (four players, two on each side) and ignored when playing singles (two players, one on each side). In doubles, even then these alleys are considered merely as extensions to the width of the court and not as separate and distinct areas of their own.

This then is the way that the naked eye physically sees either side of the playing surface of a standard tennis court, traditionally speaking.

Logical View (Horizontal Aspect). When referring to the playing surface of a tennis court, the traditional terms "backcourt" and "forecourt" are used to designate horizontal areas of the court which are often mistakenly identified with the two unequal halves separated by the service line as described in the preceeding description of the physical view. The term "midcourt" is often not even recognized at all. And when it is, it is just as often mistakenly identified in FIG. 0*b* either with imaginary lines 80 and 81 extending the service line itself which a player thinks merely separates the "backcourt" from the "forecourt;" or, with some vague spot immediately surrounding the exact center of each side of the court (Wherever that may be?).

Correctly understood, however, the three terms "forecourt" 24, "midcourt" 25, and "backcourt" 26 are all areas of equal size horizontally representing one-third of each side of the court and named for the location relative to their proximity to the net. These logical areas are seen only in the mind's eye since there are no physical lines 82 and 83 that mark them out. They are therefore sometimes hard to keep clearly in mind because the naked eye sees areas that do not coincide, but are in conflict with, the view in the mind's eye.

This then is the way the mind logically views the playing surface of a standard tennis court from the horizontal aspect of the logical view using the traditional approach of seeing things.

Logical View (Vertical Aspect). Even more confusing is the traditional approach of viewing the playing surface of a tennis court from the vertical aspect as seen from FIG. 0*c*. When a player is standing towards the right of the court for example say at location 33, he has three general and—be it noted—non specific target locations to shoot at: 34, 35, and 36; and when standing towards the left of the court for example say at location 37, he has three equally general and—be it noted—non specific target locations to shoot at: 38, 39, and 40. The expressions "down the line" 85 and 88 and "cross court" 87 and 90 are used to represent these vertical areas, as the horizontal terms were used to represent horizontal areas (though not in exactly the same way as we can clearly see), with the expression "down the middle" 86 and 89 representing neither left nor right but somewhere inbetween "down the line" and "cross court." As in the case of the horizontal aspect, 'middle' is not always thought of as an area in its own right but merely as a line 84 dividing left 31 and right 32 from each other.

These vertical expressions lend themselves to additional confusion because they are not as absolute as are the horizontal expressions in terms of location. Ambiguity and conflicting meanings arise because they are much more relative in nature. The listener may think the exact opposite of what the speaker is saying, and both in their own minds may be correct eventhough they are not communicating with each other accurately. The fact that these expressions are relative and not absolute (in terms of location) is the reason for misunderstandings between speaker and listener.

These expressions do not accurately express vertical areas on the court because each term can have two meanings depending on circumstances which are exactly opposite. "Down the line" can be either on the left side of the court; or, it can be on the right side of the court "Cross court" likewise can be either on the left side of the court; or, it can be on the right side of the court. The expressions are used relative to where the ball is coming from and where it is going to. If the listener does not know where the ball is coming from, he can misinterpret where the ball is going to. Thus rendering these expressions ineffective, and worse—misleading.

This then is the way the mind's eye is focused on viewing the playing surface of a tennis court from the vertical aspect of the logical view using the traditional approach.

Summary. So, there we have the traditional approach of looking at the playing surface of a standard tennis court consisting of two views that do not coincide with each other, but are in conflict instead. One is physical, as seen by the naked eye observing areas demarcated by lines; and the other logical, as seen by the mind's eye from the horizontal and from the vertical aspects which are not consistent with each other as the former uses absolute terms based upon location and the latter which uses relative terms based upon ball direction.

Since each view (physical and logical) and each aspect (horizontal and vertical) lends itself to its own particular misinterpretations individually, it is no wonder that when both views and both aspects are all put together, confusion in one form or another naturally results. Everyone having their own interpretations, instead of one that is commonly recognized and understood.

Moreover, neither of the two views properly describes locations on the court anyways. The Physical View is inaccurate since its real purpose is only to mark the location of the service boxes and is not intended to distinguish either 'back' and 'front' or 'left' and 'right' which are often mistakenly attributed to it. The Logical View from the Horizontal Aspect is insufficient since it only distinguishes horizontal areas which are much too broad to be of any real practical value. Telling someone to "play the backcourt" for instance, although it does narrow down the area considerably, is nevertheless still too vague a term—and area—because the question then becomes: "Where in the backcourt?" The Logical View from the Vertical Aspect, in addition to possessing the same difficulty as the Horizontal Aspect, is also ambiguous because it uses expressions relative to the location of the ball on the court, rather than to locations on the court itself as is the case with the terms which express the horizontal aspect. The horizontal and the vertical aspects are therefore inconsistent with each other in this most important of all respects.

In addition, you will sometimes hear professionals refer to what is 'the middle' as "no man's land," thus revealing the vague understanding and uncertain (if not, fearful) attitude currently prevailing about the key location of both the horizontal and vertical dimensions making up the playing surface of a tennis court.

It appears evident, therefore, that something is missing, inadequate, and altogether wrong in looking at, referring to, and playing on the surface of a standard tennis court in the traditional way which has been accepted as given without question and as a result left unchallenged by modern-day scientific analysis, until now.

Objects and Advantages: (FIGS. 1*a*–1*c*)

The solution to the problem of improving accuracy, is to clearly identify very specific and manageable areas on the playing surface of a tennis court that aren't general, vague, or ambiguous, by recognizing in FIG. 1*a* that there are three separate and distinct vertical "lanes" on each side of the court between the singles sidelines: the left lanes 41 and 44, the center lanes 42 and 45, and the right lanes 43 and 46; and that there are also three separate and distinct horizontal "zones" on each side of the court between the singles sidelines: the front zones 51 and 54, the middle zones 52 and 55, and the back zones 53 and 56. When the two dimensions are merged together at the same time, the separate and distinct lanes and zones both disappear as such, and nine other separate and distinct "sectors" appear in FIG. 1*b* on each side of the court to take their place—having characteristics of both dimensions COMBINED forming specific and manageable areas.

These newly created areas—never before revealed—are appropriately named for their relative locations on each side of the court that are formed by the intersecting lanes and zones of a grid-like shape. Thus we have: Left-Front Corner sectors 61 and 71, Left Side sectors 62 and 72, Left-Back Corner sectors 63 and 73, Back Side sectors 64 and 74, Center sectors 65 and 75, Front Side sectors 66 and 76, Right-Back Corner sectors 67 and 77, Right Side sectors 68 and 78, and Right-Front Corner sectors 69 and 79. We can shorten these already short terms even further by clipping the words "sector," "corner," and "side," thus reducing the amount of words required to convey accurate meaning. So we have: Left-Front, Left, Left-Back, Back, Center, Front, Right-Back, Right, and Right-Front. Since the first letters are unique, we can even abbreviate them as: F & B, C, L & R, LF & LB, RF & RB. In order to eliminate any possibility for misinterpretation, 'left' and 'right' refer to each player on his own side of the court; not to both sides of the court taken as a whole from only one or the other player's viewpoint. Which means that in an expression consisting of the new terms like "Right-Back to Right-Back," the term 'right' refers to the right-hand side of each of the players as they face the net.

We can now classify these nine separate and distinct areas into three common types to display their similarities. Thus we have on each side of the court: four corners, four sides, and one center. Because the Center sector has such an important place; first, in it's position; second, in it's relation to all the other sectors; and third, in it's crucial purpose (now, for the first time publically recognized in the light of day when in play, we call it "The Key Sector Location" or simply: The Key. From the standpoint of function, we name one side of the court in FIG. 1*c* "The Player Side" 09 from which the ball is hit and the other side "The Target Side" 10 at which the ball is hit, on either side of Net Line 50. For the sake of presentation, we illustrate the Player Side as the side of the court that's at the top of the drawings; and, the Target Side as the side of the court that's on the bottom of the drawings.

An individual sector is ideal in size for both sides of the court (i.e. the Player Side; and, the Target Side) because it is neither too large an area to cover by the body and to aim at with a ball (as was the case with the Traditional Theory, like "backcourt"); nor, are they too small an area (as was the case with the Traditional Practice of using whatever presented itself as a candidate for a target, like ball container covers which aren't much bigger than the circumference of the ball itself—which isn't all that big to begin with).

We have thus disclosed "the idea" behind the invention; and in addition, have provided appropriate terminology that is not general, is not vague, and is not ambiguous but is specific, clear, and precise in referring to the playing surface of a tennis court. We can now proceed in describing the invention as such.

Description of The Invention: (FIGS. 1*c*, 2*a*–2*d*, 3*a*–3*b*)

Surfaces

Introduction. Physical sector surfaces, imposed by the invention, make the logical sector locations visible. The physical view as seen by the naked eye, and the logical view as seen by the mind's eye are made to coincide and be "in sync" with each other, thus breaking the bad habits of incongruency—fostered by traditional theory and traditional practice—by its very presence.

There are three models of the same invention entitled "Tennis Court Trainer" (which when used for the playing surface of a tennis court may then be called: a "Training Court") based upon size: Full-Size Playing Surface, Half-Size Playing Surface, and Sector-Size Playing Surface. The only difference between the surface sizes being the number of logical sector locations occupied by physical sector surfaces at any one time. All three are based upon the same solution to the problem of improving accuracy for tennis players. The essential characteristics of Tennis Court Trainer are: size, shape, and placement. Everything else, albeit necessary and important, are secondary features as it relates to the essence of the invention. The first two characteristics, size and shape, of each model of the invention now follows.

The Full-Size Playing Surface Model is as big as the entire size of the tennis court between the singles sidelines on both Player Side and Target Side of the court, and is rectangular in shape: 27 feet wide and 78 feet long for a total playing surface area of 2,106 square feet (8.23 meters by 23.77 meters covering 195.6271 square meters). In order to reveal and emphasize the sector types (corners, center, and sides), a checkerboard pattern in FIG. 1*c* is created with alternating light and dark colored sectors; sector types on each side of the Net Line 50 having the colors reversed (e.g. corner sectors on one side are dark, while on the other side the corner sectors are light). In order to be able to locate the service boxes which are covered up by the full-size playing surface, the service lines 07 and 17, center lines 08 and 18, and center marks 03 and 13 are marked on the surface by broken lines. Patterns and lines are all optional, however.

The Half-Size Playing Surface Model is as big as half the size of the tennis court between the singles side lines for only one side of the court; either the Player Side, or the Target Side; and is rectangular in shape: 27 feet wide and 39 feet long for a total playing surface area of 1,053 square feet (8.23 meters by 11.885 meters covering 97.8135 square meters). FIGS. 2*a*–2*b* shows the same lanes, zones, and sectors that exist for the Half-Size Playing Surface as for the Full-Size Playing Surface; what appears on the Player Side also applies for the Target Side which isn't shown since it's the same. A checkerboard pattern in FIGS. 2*c*–2*d* is created as previously described for the full-size playing surface, with Player Side and Target Side having reversed patterns of dark and light sectors. Service Lines, Center Lines, and Center Marks are also marked as previously described. Patterns and lines are all optional as already stated.

The Sector-Size Playing Surface Model is as big as one-ninth the size of one side of the court between the singles side lines or, in other words, the same size as one logical sector location; and is rectangular in shape: 9 feet wide and 13 feet long for a total surface area of 117 square feet (2.7433 meters by 3.9616 meters covering 10.8678 square meters). In order to distinguish Player Side from Target Side, one sector-size surface is dark in FIG. 3*a* and the other is light in FIG. 3*b*. Service Lines, Center Lines, and Center Marks are also marked as previously described. Patterns and lines are all optional as already stated. Each individual sector is in direct proportion to each side of the tennis court, thus making it a miniature size court; and, each side of the court may be looked upon as just an oversized sector.

Conclusion. Opposite sides of the same surface may be reversible so that one side is light and the other side dark; also, one side could have identifiers for alignment and the other side have identifiers for subsectors. While length and width of the three models of playing surfaces are predetermined by the size of the court itself which is a given, thickness is not so determined, and may vary as improvements are discovered over a period of time thru actual use.

Substances

Introduction. As the essential characteristics of Tennis Court Trainer are size, shape, and placement of surface; almost any solid substance, rigid or flexible, may be used in it's construction (size and shape were discussed under Surfaces in Description of The Invention, placement will be discussed in Operation of The Invention under Placement).

However, because of secondary considerations such as durability which depends on toughness of material, portability which depends on weight of material, storability which depends on the ability to reduce the size of the material, and "bounce" which depends on how a tennis ball reacts when it hits the surface of the material; the following features are considered.

At this point of the disclosure, however, it must be emphasized again that the features which follow have no direct bearing on the purpose of Tennis Court Trainer namely accuracy, which is the direct result of its essential characteristics: size, shape, and placement. All of the features are secondary, and are dependent upon the materials that are used.

Durability. The Tennis Court Trainer can be made of a strong material that will take a lot of wear and tear over a long period of time, be permanent in nature although higher in cost; or, it can be made of a weaker material that will withstand use over a short period of time, be disposable in nature although lower in cost. The material shouldn't curl crack, or split though, and should lie perfectly flat and conform itself to the contour of the court.

Portability. If the Tennis Court Trainer is intended for repeated placement and removal, a lightweight material can be used; if intended for a more or less permanent placement being almost never removed, a heavyweight material can be used that will also resist the weathering effects of sun, wind, and rain. It shouldn't slide around, however, but should stay in place.

Storability. If Tennis Court Trainer is not needed to be stored away, a rigid material may be used; if storage is required, a flexible material that can be rolled up or folded up may be used.

Bounce. The materials used can produce the following effects: a "dead bounce" to arrest the velocity imparted to the ball; or, a "live bounce" which simulates a particular kind of playing surface: a "slow bounce" simulating the surface of a clay court, and a "fast bounce" simulating the surface of a grass court. A "slow bounce material" need not be used only on a "slow" clay court, but also on a "fast" grass court as well; just as a "fast bounce material" need not be used only on a "fast" grass court, but also on a "slow" clay court as well.

Conclusion. Features are options tailored to suit the particular needs and wants of different customers, and are therefore important in that regard eventhough they have nothing whatsoever to do with the primary function of Tennis Court Trainer which is to develop accuracy (which depends upon its three essential characteristics of size, shape, and placement). It is up to the consumer to determine which features are popular, and consequently which kinds of Tennis Court Trainer will be manufactured.

Any material, or combination of materials, that serves the feature purposes above described may be used to provide them to the public, such as solids like: wood, rubber, plastic, plexiglass, polyurethane, Samsonite, tile, linoleum, carpeting, vinyl, fabric, cloth, canvas; or fluids that solidify like: paint, powder, and foam. Other features that may come to light over a period of time thru use of the invention, such as features that have sense appeal like color and acoustics, may also be incorporated. In other words, the invention is not limited only to the above named features and materials.

Operation of The Invention: (FIGS. 1*d*, 2*e*–2*f*, 3*c*–3*h*, 4*a*–4*f*, 5*a*–5*d*, 6)

Placement

Introduction. As the first two essential characteristics of Tennis Court Trainer, namely size and shape, were dealt with under Surfaces in Description of The Invention; the third essential characteristic, namely placement, is dealt with here in Operation of The Invention. As used in our presentation, "placement" can have two meanings: placement of ball (accuracy), and placement of playing surface. It is the second meaning that is dealt with here. Placement consists of direction and location: direction meaning how the surface is placed on the court, and location meaning where it is placed on the court. The direction of the surface is placed so that the smaller side of the rectangle is horizontal and the longer side is vertical, and not vice versa. Location means that the surface is placed directly over the appropriate number of sector locations depending on the playing surface size: Full-Size, Half-Size, or Sector-Size; described as follows.

Full-Sized Playing Surface Model. As seen in FIG. 1*d,* There is only one way to place a full-size surface 91, and that is directly over the tennis court between the singles side lines thus occupying all eighteen logical sector locations (nine sectors each, on both sides of the court).

Half-Sized Playing Surface Model. There are two ways to place a half-size surface 92: as seen in FIG. 2*e,* it is placed directly over the Player Side of the court between the singles side lines; as seen in FIG. 2*f,* it is placed directly over the Target Side of the court between the singles side lines. Thus all nine logical sector locations on either side of the court are occupied.

Sector-Sized Playing Surface Model. Since there are eighteen logical sector locations on a tennis court (nine on each side), there are therefore eighteen ways to place a sector-sized playing surface on a tennis court (nine on each side) which occupies a single sector location. When occupying the center sector location, it is referred to as the Standard Placement and is said to be "on key;" when not occupying the center sector location, it is referred to as an Alternate Placement and is said to be "off key." The reason the center sector placement over the key location is so uniquely important is because all the other eight logical sector locations can be easily "made out" by the mind even without sector surfaces physically present to occupy them since the other sectors (four distinct sides and four distinct corners) immediately surround it.

A sector-size model can be placed on one side of the court alone: FIG. 3*c* shows it only on the Player Side, FIG. 3*d* shows it only on the Target Side; but it is primarily intended to be used as a set in pairs, one on each side of the court in singles play as shown in FIG. 3*e* which is the standard placement. FIGS. 3*c*–3*e* show the sector-size surface placed over The Key sector locations of the court. FIGS. 3*f*–3*h* show various combinations where the sector-size surface is placed over sector locations other than The Key; FIG. 3*f* shows an alternate placement example on the Player Side; FIG. 3*g* shows an alternate placement example on the Target Side; and FIG. 3*h* shows an alternate placement example on both sides.

Two sector-sized surfaces are used on the same side of the court when playing doubles. FIG. 4*a* shows placement of surfaces for Player Side Doubles, FIG. 4*b* for Target Side Doubles. FIG. 4*c* is the standard placement for doubles, while the remaining figures show alternate placements: FIG. 4*d* an alternate placement for Player Side doubles, FIG. 4*e* for Target Side doubles, and FIG. 4*f* for both sides of doubles play. Each of the two alleys is 4.5 feet wide, exactly half the width of one sector. The two alleys taken together, therefore, add three more sector locations per side giving each side of the court a total of twelve instead of nine (a court total of twenty-four for doubles versus eighteen for singles). But although the total number of locations on the court is more and the total number of square feet is increased overall because there are two players instead of one per side, each player has to cover less and the total number of square feet is decreased per player; or, six instead of nine sector locations each. The grid arrangement of nine still holds true however, except that the left and right lanes are now half a sector each in width. Placement of the sectors in order to be centered for each player in his respective domain is no longer the Center sector as in singles, but the Left Side sector and the Right Side sector.

In addition to singles and doubles, there is a third way of playing that combines both singles and doubles arrangements. FIG. 4*g* shows the standard doubles placement on the Player Side and the standard singles placement on the Target Side; while FIG. 4*h* shows the standard singles placement on the Player Side and the standard doubles placement on the Target Side. Such arrangements are called "Two On One" and "One On Two."

A Sector-Size surface is positioned for placement on one of the three sector locations types as follows. For a Center sector location type: the sector surface is positioned vertically by aligning the center line on the surface with the one on the court, and horizontally by aligning the service line on the surface with the one on the court. For a Side sector location type: if a vertical location (front or rear), the sector surface is positioned vertically by aligning the center lines, and horizontally by aligning the front or rear edges depending on which Side sector; if a horizontal location (left and right), the sector surface is positioned horizontally by aligning the service lines, and vertically by aligning the left or right edges depending on which Side sector. For a Corner sector location type: the front or rear edges are used to position the surface vertically depending on which Corner sector, and the left or right edges are used to position it horizontally depending on which Corner sector. A sector could be placed "offset" so that it is not superimposed over a location exactly if the player is only concerned with getting the feel of a sector, but this defeats awareness of location which should be practiced at the same time; although, a sector can be "offset" in doubles to cover an alley which is half a sector in width.

Combined Half-Size Playing Surface and Sector-Size Playing Surface Model. For singles play: FIG. 5*a* shows the Half-Size Surface on Player Side of the court, and Sector-Size Surface on Target Side; FIG. 5*b* shows Sector-Size Surface on Player Side, and the Half-Size Surface on Target Side.

For doubles play: FIG. 5*c* shows the Half-Size Surface on Player Side, and two Sector-Size Surfaces on Target Side; FIG. 5*d* shows two Sector-Size Surfaces on Player Side, and the Half-Size Surface on Target Side.

Conclusion. Any of the three models of Tennis Court Trainer—Full-Size Playing Surface, Half-Size Playing Surface, and Sector-Size Playing Surface—may be placed on, affixed to (temporarily or permanently), or be an integral part of the tennis court itself.

Practice

Introduction. As shown in FIG. 6, the primary purpose of any Tennis Court Trainer whether Full-Size 91, Half-Size 92, or Sector-Size 93, is to improve the accuracy of a shot 97 by a player 95 hitting a ball 98 with a racket 96 from a player sector 94 on one side of the court, over a net 19 to a target sector 99 on the other side of the court, whether a partner 100 is present or not (the partner is shown in the drawing off the court to represent being optional and not required). This, in a nutshell, is basically how the invention is used, employing Julius Caesar's famous dictum: "Divide, and conquer!"

The Full-Size Playing Surface Model and Half-Size Playing Surface Model are intended for professional use by clubs, clinics, schools, spas, and anywhere else where tennis courts are owned by institutions or private individuals. The Sector-Size Playing Surface Model is intended for personal use by players who don't have access to a court that has the professional models available for use.

One of the many advantages of this invention is that you don't have to have a partner in order to use it, although a partner can be used if available. Also a full-time coach isn't required to instruct a player. The player could have a coach check-up on him from time to time to offer guidance, or he could read the instructions that would accompany the invention and teach himself. Under some circumstances this may, in fact, be the best thing to do. If a coach is too biased by the prior art, he can hinder the effectiveness of the new invention and hamper the player's progress. It should be remembered though that the invention itself is the real trainer. In the past, a player who practiced by himself on his own without the benefit of a partner or a coach was, quite literally, spending time on the court "aimlessly" as he had no knowledge, and no means, by which to practice the drill routines that are now going to be presented for the first time anywhere, prior to the invention of Tennis Court Trainer.

Player Side of Court From the standpoint of a sector representing a player area which is traversed by the player moving to its four sides vertically (forwards and backwards), horizontally (to the left and to the right), and to its four corners diagonally, "it's just one step away" in reaching any extremity without undue strain when the player is positioned in the center of the sector, and with little effort when positioned other than in the center of the sector. Once a player has thoroughly practiced "traversing" a single sector from all possible directions (vertically, horizontally, and diagonally) when positioned in the center and when not positioned in the center, he will have mastered how to traverse any of the nine sector locations occupying the player side of the court.

Mastery of the entire player side of the court is achieved, however, when a player then practices "travelling" between sector locations: to each of the four side sectors (front and rear vertically, left and right horizontally) and to each of the four corner sectors (left-front and left-rear, right-front and right-rear diagonally) which are all "right next door" to the center sector location which is the keystone of the grid-like structure, and: "The Key" to the court. Theoretically, if a player can learn to control his own center sector, he can control the entire player side of the court; and, can thereby command control of the target side . . . as well.

This "body positioning" or "maneuvering" may be practiced by first using the Sector-Size Playing Surface Model to "get the feel" of traversing a sector, and then by using the Half-Size Playing Surface Model to practice "what it's like" travelling between the sectors. Like a soldier "on maneuvers," practicing this elementary "footwork" develops court consciousness, something that traditional training totally neglects because it simply wasn't aware of such a thing that is only now made possible by use of this invention.

Target Side of Court. From the standpoint of a sector representing a target area which is aimed at by a player and hit by a ball shot from the player's racket, it is neither too large an area as to "hit the broad side of a barn" on one extreme, nor too small an area as to "thread the eye of a needle" on the other extreme. It is neither too small in size as being almost impossible to hit, which Traditional Practice presented as ball container covers; nor too large in size as being almost impossible to miss, which Traditional Theory presented as physical halves (left/right and fore/back) or logical thirds (left/center/right and fore/mid/back). Lanes and zones were both too large, lines and spots both too small; sectors are ideal, neither too large nor too small.

Motion consists of a sequence of fixed positions, master the fixed positions individually and you master the sequence. You can do this by fixing some aspects in order to isolate and work on a variable aspect. There are three spatial aspects involved in every shot: length, width, and heighth. The invention fixes two of the three, length and width, by the presence of a Player Sector and a Target Sector, the player practices the third aspect, heighth, which varies with the shot being developed like: soft high lobs; or, hard low drives. All the variables of "form" should be used to adapt the shot for "placement." Such variables include: which arm to use, left hand or right hand; which racket face to use, forehand or backhand; and what kind of "English" or "spin" to use: top spin, which makes the ball arc in the air and skip on the bounce; under spin, which makes the ball glide thru the air and skid on the bounce; side spin, which makes the ball curve in the air and jump to either side on the bounce; or flat (no) spin, which just lets the ball succumb to gravity with "nothing on the ball;" also, how much "stuff" to put on the ball which determines the rate of rotation for adjusting the speed of spin (revolutions per minute) which cause the effects of drift and drag in varying degrees; and, speed of shot (miles per hour).

This "ball placement" may be practiced by using the Sector-Size Playing Surface Model to "get the feel" of hitting a sector until a certain level of consistency is reached, then the Half-Size Playing Surface Model may be used to practice hitting all the different sectors; again, until a certain level of consistency has been reached. Consistency meaning, of course, the number of times the target is hit by the ball each time the ball is hit by the player.

Player Side and Target Side Combined. Once a certain level of consistency has been reached on the Player Side of the court in body positioning, and on the Target Side of the court for ball placement, practice can be combined using the Full-Size Playing Surface Model to advance the skill of accuracy under conditions that aren't so restricted. But still, the invention nevertheless isolates aspects of the game, as is to be expected, since practice by its very nature is deliberately intended to isolate individual aspects in order to achieve mastery of that particular aspect which can then be incorporated with other aspects which have already been mastered or which will be mastered in the due course of time.

The Prior Art didn't consciously recognize that there are two locations involved in every shot, not just one; because if it did recognize it in theory, it didn't provide for it in practice. A target location was selected (with no real concept of placement, but that's beside the point) and marked by placing an object (with no real concern for what kind of object, but that's also beside the point) so a player knew where he should hit the ball to. But the same wasn't done for the location where he should hit the ball from; it was left up in the air, so to speak Concentration was so focused on ball destination that ball origin was effectively ignored. Both locations must be recognized and appreciated as depending on each other for practice to be effective in order to develop accuracy. Consistency cannot be achieved when the player location isn't just as well fixed as the target location is.

Tennis Court Trainer recognizes this intimate relationship in its design and terminology: Player Side and Target Side; and, Player Sector and Target Sector. As there are nine possible Player Sectors from which the ball can be coming from on one side of the court, and nine possible Target Sectors to which the ball can be can be going towards on the other side of the court, there are therefore eighty-one possible combinations to consider. As examples of each and every combination is not necessary for understanding how Tennis Court Trainer operates, only samples of the major types of combinations have been explicitly presented under Placement with other combinations of that type implied in the example. Which is to say that, no limitaton is assumed by the mere absence of one of the possible combinations provided in the presentation. That being said, we now draw our attention back to the two interrelated locations involved in every shot: ball destination—and—ball origin.

The ball may originate either from the player himself who is standing on one of the nine player sectors on the player side of the court; or, it may originate from the other side of the court by a machine which, or a partner who, propells the ball at the player standing on the player sector on the player side of the court. The machine or person may be positioned on the target sector itself, or on any one of the other eight sector locations on the target side of the court. The former used to practice hitting the ball at an opponent, the latter used to practice hitting the ball away from an opponent. The player hits the ball with a racket either after it bounces, by practicing to "stroke" the ball; or before it bounces while still in flight, by practicing to "volley" the ball. If a player is ambidextrous, or wants to develop ambidexterity by utilizing both arms (as he does both legs), he can practice hitting the ball with either hand and develop thereby even more ability and agility (another area of traditional thinking that is severely biased and left neglected).

By combining the basic skills separately developed for body positioning and for ball placement the player is now prepared to develop the advanced skill of "getting around the ball" in order to "get an angle on the court." This teaches the player to actively "play the ball" and not passively let the ball play him. For although the ball does make a number of variables fixed and predetermined, a player can nevertheless capitalize on possibilities not determined by the ball. This can be demonstrated by the following instances: instead of waiting for the ball to come to him, a player can "go after it" by charging forward to intercept the shot if the ball was hit to him soft; if the ball was hit too hard for him to handle, the player can "buy time" and let it lose momentum by retreating backward to retrieve it; or, a player can outflank his opponent by learning to move himself "around" the ball either to the left or to the right thereby opening up a sharper angle on the ball in respect to the playing suface which forces his opponent to move wide of the court All of these instances "free" a player to take the initiative above and beyond what the ball requires him to do just to "play" the shot—and, it keeps the opponent guessing as he must now worry about what's not normally expected under the circumstances. But, all of this entails "fancy footwork" in order for the player to position himself on a different sector location or on another location of the same sector in order to take advantage of opportunities not normally considered because they must be created by the player himself who doesn't rely on the ball alone to determine the kind of shot he will hit.

Unlike all other traditional ways of practicing to hit a ball which consciously or unconsciously concentrates on how to hit the ball to acquire good "form," Tennis Court Trainer directly forces the player to concentrate his attention on how to hit the ball accurately to acquire good "placement." Where the ball is going is the primary purpose, how it gets there, though indeed important, is now secondary. Accuracy is developed literally thru "hit and miss" until a player "finds the range" under static conditions where the player sector and target sector are both fixed and not variable, and until he "hits the mark" by continually making adjustments to the amount of force imparted to propel the ball by the racket which determines velocity of the shot, and the amount of elevation imparted to the ball by the tilt of the racket head which determines trajectory of the shot; till the combined elements of telemetry become a conditioned reflex, and accuracy—something thought impossible to achieve—becomes natural and even second nature as the player reacts instinctively from habits cast in the die of the invention.

Stages of Practice. As there are any number of combinations for using this invention, we will leave it up to the professionals of the future who will devise the best strategies and tactics based upon the possibilities presented when actually applied to a particular player's talents and abilities in logistically competing against another opponent's given talents and abilities, as this is beyond the scope of our presentation. But, three basic stages of practice can be outlined to proceed as follows.

In the first stage, both player and target are made stationary (i.e. same player sector, and same target sector); next, a moving target is introduced with player remaining stationary (i.e. different target sectors, but same player sector); then, the player can be moving with the target remaining stationary (i.e. different player sectors, but same target sector); after that, both player and target can be "on the move" (i.e. different player sectors, and different target sectors).

In the second stage, the presence of a partner can be introduced to more closely simulate actual play, but still, under deliberately restricted conditions. One player can be restricted to shooting at only the four side locations as target sectors, and the other player restricted to the four corner locations; or, both players can be restricted to the four sides, or to the four corners. Thus two players can benefit from this kind of target practice at the same time, in a restricted kind of "free for all."

And finally, in the third stage, the results of all this extensive practice can be tested out in real life as it's time to play the game, but now, well prepared and fully equipped for doing so. The player by now should possess knowledge and skill; and consequently, confidence in facing any competitor head on. The third stage should be regarded by a novice player as just another stage of practice where the invention is physically absent from the court, so that he can identify his own weaknesses and thereby know what should be practiced when the invention is once again physically present on the court.

Conclusion. Before the invention of Tennis Court Trainer, that is—up until now—the only training technique thought to exist amounted to, what may now be called in retrospect, "ball control." Though various ways were devised, they all had the same direct effect of practicing "HOW to hit a tennis ball with a tennis racket using various strokes of the arm and grips of the hand." With Tennis Court Trainer, a technique is now available for the first time for what may be called "court control" which takes the traditional technique one step further by adding to it ". . . in order to place the ball WHERE you aim it" by practicing the two basic elements in every shot: body positioning (on the player side of the court) and ball placement (on the target side of the court). The invention trains the player to control both body and ball—separately, and together. It also trains the two body areas directly involved, arms (for hitting) and legs (for running)—separately, and together. A player's concentration is held sharply in focus using this invention because the eyes have physical locations that can be seen which prevent them from wandering, and the mind has logical locations that are in sync with the physical locations which prevents confusion and instills assurance thereby allowing the player to give an "all out" effort. Thus making training comprehensive, and complete. Accuracy is now not only possible to develop effectively, by using this invention—and not just as an indirect by-product which follows the development of "good form"—but can be developed efficiently as well, by using the invention as has been thus described. For, it's one thing to merely spend time on the court "practicing," and quite another to spend it productively and purposefully directed by intelligent objectives developed thru concentrated effort. In the second case, you know what you're doing—and why!

Summary, Ramifications, and Scope: (FIGS. 7*a*–7*b*)

Benefits

Introduction. Although the foregoing presentation contains many specificities, these should not be construed as limiting the scope of the invention but as merely providing illustrations of some of the presently preferred embodiments of it. For example, other models could conceivably be devised other than the three basic ones described, where solid or broken lines instead of surfaces make the logical sector locations physically identifiable, in which case the sector surface is actually the surface of the court itself. Also, the alleys could be made a part of the model surface, covering the court all the way to the doubles sidelines on each side. And, a physical sector surface may be either somewhat smaller than or somewhat larger than a logical sector location. Thus the scope of the invention should be determined by the appended claims and their legal equivalents, rather than by the examples given.

What follows next are the effects anticipated by the invention of Tennis Court Trainer as it benefits the world of tennis which include: Accuracy, Communication, Understanding, and Marketability.

Accuracy. Even as we speak, it is a commonly held belief by professional tennis experts that accuracy cannot be improved to any measureable degree. This is quite understandable given the traditional environment which tennis has been confined to before the advent of the invention herein disclosed for the very first time.

Accuracy, the ability to place the ball where you aim it, was being hindered by the very thing—form, the ability of how you hit the ball—that should have been helping it. Form was something that was developed for its own sake, unrelated to placement. It's no wonder accuracy wasn't developed "to any measureable degree!" The traditional approach put the cart (form) before the horse (accuracy).

Tennis Court Trainer provides the tennis world for the first time in its century-old history with equipment to develop accuracy deliberately and directly, and therefore: effectively. The sport now has apparatus on which players can practice improving this most important of all skills, efficiently. The invention corrects the awkward and backward arrangement of the traditional approach by putting the horse where he always belonged—before the cart. The cart is no longer being pushed by the horse, but pulled by it instead. The horse now having "free rein" to maneuver, instead of being "blindered" by the cart which obstructed its vision and impeded its movement. The blinkers have now come off! A player should practice to develop accuracy, not to develop form per se; form will follow as a natural consequence, if accuracy is allowed to lead.

What good is it HOW you hit the ball, if you can't place it WERE you want it? Form will now follow function as it should. The idea of form for its own sake will have to conform itself for the sake of the higher purpose, which is: accuracy. In fact, new forms may even be devised as new theories inspire new practices. Tennis Court Trainer provides the practical solution to an age-old theoretical problem which was once thought by some of the best in the field to be impossible to solve in practice, up until now.

If a player practices diligently using the invention, accuracy will develop inevitably since "practice makes perfect" and he'll discover he has superior skill and "court sense" over an opponent who hasn't been trained so thoroughly. He'll have that all important "edge" over anyone else not so trained. Once he's practiced in "playing the court," he'll then be prepared for "playing the person."

Communication. In addition to improving accuracy of shot, accuracy of language is also improved; impacting both the spoken work and the written word as well.

Now, when attempting to communicate where a ball is hit from and where it's hit to, no longer will . . . general . . . vague . . . and ambiguous . . . expressions like "forecourt" and "backcourt," or "down the line" and "cross court" be used; but specific, clear, and precise expressions like "front to right-front" and "back to left-back," or "left to right-back" and "right to right-back." What a difference this makes in verbal communications for transmitting accurate meaning between speaker and listener! Not just players, but coaches, trainers, commentators, sports announcers, and spectators should find the new common parlance preferable to the old arcane jargon; as the traditional horizontal and vertical terminologies will be clearly seen as the archaic abstractions that they are, and become antique relics of the past where they now belong.

Because the traditional tennis vocabulary is incapable of describing specific locations of the court and because it's incapable of relating specific locations on each side of the court to each other meaningfully, it's not surprising that you will not find a play-by-play narrative in the sports section of a newspaper giving a detailed description how a particular point was played. Such a thing is much too difficult to attempt, if not impossible to do—under present conditions. Up until now, fans had to be content with statistical scores and a general picture of what actually took place on the court. But now, tennis has a vocabulary capable of providing a "blow-by-blow" narration. By combining how a shot is hit (form), with where the shot is hit (placement), a segment from a running commentary would sound something like this: ". . . . Borg lobs from left-back corner to right-back corner; Connors drives from right-back corner to center; Borg volleys from center to left side, and puts the ball away to win the point. . . ." Now, when a particularly brilliant rally has just taken place during play, it can be orally reported and recorded in writing for the benefit of all posterity who will be able to picture what took place, shot-by-detailed-shot using language that is understandable to everyone.

And if greater precision is desired for pinpoint accuracy of location, a sector itself can be divided into subsector locations that correspond in terminology with the sector locations on each side of the court as pictured in FIG. 7*a* by dividing vertically each of the three lanes into sublanes 101–109 and 111–119 and dividing horizontally each of the three zones into subzones 121–129 and 131–139 all of which are named under Reference Numerals in The Drawings. Thus producing in FIG. 7*b* the following nine subsector locations for every sector location: Left-Front Corner 141, Left Side 142, Left-Back Corner 143, Back Side 144, Center 145, Front Side 146, Right-Back Corner 147, Right Side 148, and Right-Front Corner 149. There are thus four Corner subsectors, four Side subsectors, and one Center subsector per sector, each subsector being 3 feet wide and 4⅓ feet long for a total playing surface area of 13 square feet (91.44 cm by 132.08 cm covering 12,077.3952 cm). Eighty-one grandchildren are propagated from the nine parent sector locations on either side of the court (one hundred sixty-two for the entire court), which themselves were propagated by their vertical and horizontal parents (lanes and zones), providing the ability to identify any and all of these numerous locations very precisely—and yet—very easily, using terminology that is simple and consistent—if required. Although logical subsectors could themselves be made physical, they are really too small in area to serve the function that an entire sector does whose area is composed of nine of these subsectors, other than perhaps serving as a kind of "reference point" for the vicinity of a logical sector location. Our running commentary, when adapted to include subsector references, would now sound something like this: "..... Borg lobs from the front side of the left-back corner to the back side of the right-back corner; Connors drives to the left of the center; Borg volleys to the left-front corner of the left side, and puts the ball away. . . ." Notice that once the destination location has been stated for one player, it need not be repeated as the origin location for the other player.

As locations are thought of (logically) and seen (physically) in terms of sectors, the court itself can be viewed in FIG. 7*b* as being composed of two supersectors, the Player Supersector 150 and the Target Supersector 151; which are each composed of nine sectors which, in turn, are each composed of nine subsectors; thus demonstrating the inter-relationships of all the components comprising this invention, and providing a means for referencing any location, large or small, in a consistent manner.

Understanding. To quote a tennis pro who is also an expert trainer "Tennis is not a well understood sport" (Vic Braden, "Tennis for the Future" 1981, videotape 1 of 3, his very opening remarks). Part of the problem for its being not well understood is due to the traditional way that the playing surface of a tennis court is viewed physically and logically; and, the terminology that's been a part of it's common parlance which focuses only on that viewpoint as has been explained in detail in Background of The Prior Art. Tennis Court Trainer overcomes both of these obstacles making the physical view coincide with the logical view by the presence of physical surfaces which occupy logical locations; and, by providing terminology that is not general, but specific; not vague, but clear; and not ambiguous, but precise. Thus solving the most important part of the problem for tennis being "not a well understood sport." The other part of the problem, which is the remaining source of confusion, is the method and jargon for scoring the game which is not the subject of the problem addressed by this invention but is mentioned so as to get the proper perspective towards the problem as a whole in order to show the significant impact that Tennis Court Trainer will have on, not only improving accuracy and communication, but on improving understanding of the very game itself. The sport as we now know it will be revolutionized as a result of this invention, since it makes locations on the court: identifiable, referenceable, and playable.

This is so, because the game will now for the first time be clearly understood as a result of eliminating all the confusion and misconceptions perpetrated by the Prior Art which has been enshrined by customs and tradition. Many more people who may have been initially put off by not understanding the sport may now give it a second look, try it anew, and discover that they like it afterall. This sport which was originally the province of the nobility and the well-to-do may be opened up even further for the recreation and enjoyment of the common man who may even devise new ways of playing tennis.

The public alone will not just benefit from the result of using Tennis Court Trainer, but the professional players themselves whose minds have been handcuffed—without their even realizing it—finding fresh new insight into the game that will dispel bogeyman beliefs like "no man's land" once and for all, a game they thought they knew so well, as the mysterious "no man's land" which had been treated as something to be avoided at all costs is transformed into "the key to the court" which will be treated as something to be mastered at all costs.

Traditionally speaking, the horizontal 'middle' and vertical 'center' were not very well understood. Sometimes they weren't recognized at all, and sometimes they were recognized as being mere dividing lines between two other areas that were recognized (i.e. front and back; and, left and right). The horizontal areas and the vertical areas were thought of as being separate, and not thought of as being integrated. Tennis Court Trainer changes all that, by marrying the two parent dimensions thus producing a family of brand new offspring called sectors, providing specific and manageable areas that can be easily covered by the player with his legs on the player side of the court, and areas that the player using a racket with his arms can be easily aimed at—and hit with a ball—on the target side of the court, because these areas are neither too big nor too small in size. Also, 'middle' will now come into its own as an area in its own right. And not just identified, but recognized as being "the key" to the court. Once a player realizes that when he can control the Center sector location on his side of the court, he can also control his opponent's side of the court as well, "power" will be tamed by "placement."

And more than improving accuracy—which is THE major breakthrough—the manner in which the game is played will be affected as a by-product This is a case of where the whole is greater than the sum of its parts, for Tennis Court Trainer will have a synergistic impact on the tennis world. The era of the power play sluggers where players erected fortifications on the baselines with long-range artillery blasting cannon ball shots to breach the enemy stronghold dugin on the other baseline, are now outdated. "The Maginot Line" may be as impregnable as a castle, but it can be circumvented by simply playing around it. The days of trench warfare as applied to tennis are numbered and in theory is now passe as "no man's land," where only the foolheardy and the brave of heart once dared go when venturing out of their baseline fortress, will now become the position "to fight for." The baseline will no longer be the safe and secure haven it once was, as it is at the present time. To borrow a saying from the Bible: "The stone which the builders had rejected has become the cornerstone" (Acts 4:11).

The effects of this knowledge will not only affect present strategy and tactics of playing the game; that is, the manner it is played but will also affect a concept and word which has been conspicuously absent from the game for quite some time called "manners." Since fierce and forceful shots will no longer be required to win points, savage tempers designed to "pump yourself up" as currently displayed will be replaced by civilized behavior; brute force succumbing to controlled finesse. With the new knowledge, coupled with the ability to improve accuracy—a skill which was once thought to be impossible to improve—sportsmanship will make a comeback over the ignorance and barbarism of the recent past—and win! "Tough" will lose to "touch," as controlling "hot shots" will require keeping "cool." Since the mind will be employed in playing the game to a greater extent than it is now, we can expect to see longer rallies, more volleying, and gentler but more calculated shots. Instead of trying to "put it away" every time the ball is hit, the general attitude will be just to "put it in play." Emotional excitement over a shot hit "A hundred sixty miles an hour!" will be replaced with intellectual delight over a shot "Well hit!" Tennis will have outgrown it's rambuncuous and thoughtless adolesence into a more refined and thoughtful maturity as it comes into its prime; still played with the energetic effort of a competitive sport, but also with the leisurely enjoyment of a recreational game which the equipment now provides for. As we are all a product of the times in which we live, no one can be faulted for succumbing to prevailing beliefs of the age, but a new day has dawned for tennis as the old makes way to improvement and to progress.

These are the effects that can reasonably be foreseen caused by the beneficial impact that this new invention will have on the tennis world, and even upon society at large, as these new and unexpected results manifest themselves due to this invention.

Marketability. As tennis is a sport played 'round the world, but especially in The Big Four "grand slam" countries of Britain, France, Australia, and the United States, the invention should have world-wide international appeal. In the marketplace, the invention should be profitable for the manufacturer and the retailer, and affordable for the consumer. Because the invention has potential high-volume commercial value (as any player, professional or amateur, at any level whether advanced, intermediate, or beginner can profit from its use), American industry can profit economically by providing a solution to an unsolved problem which was once thought to be "insolvable," producing a new generation of better trained players coming up thru the ranks to challenge traditional players and provoking a rivalry that should spark even more life in this already very popular game that has become somewhat stolid and "set in it's ways." And out of all this healthy competition will emerge one day: the consummate tennis player, which this invention will have been responsible—in no small way—for producing.

Conclusion. This practical invention provides a solid foundation, and the theoretical technique of operating it provides a sturdy framework, upon which a player can now apply the brick and mortar of "form" to build up his accuracy. Without the invention, the raw materials of form have no foundation or framework, and development proceeds without a well-designed blueprint to manage a players limited resources of time, effort, ability and ambition—as has been the situation up till now.

Glossary of Terms

As new terminology has been introduced as a result of Tennis Court Trainer; and, as terms tend to blend into each other, so much so that they become almost interchangeable at times such that distinctions are then blurred, the following definitions are provided all in one place together so that they can be compared for differences in meaning; and, to assist in interpreting the Claims.

| | |
|---|---|
| Logical Location | Any area (e.g. Lane, Zone, Sector) as "seen" and recognized by the mind without the aid of physical means. |
| Physical Location | Any area (viz. Logical Location) made physically identifiable by some means (i.e. surfaces, lines, or whatever). |
| Tennis Court | As used in the context of this presentation, a tennis court consists of two elements: the horizontal playing surface, and the vertical net. Although, in a broader sense it can mean the surrounding apron area with the fences, bleachers, and umpire chairs taken all together collectively. |
| Playing Surface | The entire area of the tennis court demarcated: horizontally, between the two base lines on either side of the net; and vertically, between the doubles side lines (including both alleys on either side of the singles side lines). |
| Player Side | The side of the playing surface of the court from which a player hits a ball If a player is on both sides of the court, each sees his side as the player side |
| Target Side | The side of the playing surface of the court at which a player aims a ball. If a player is on both sides of the court, each sees the other side as the target side |
| Lanes | The three vertical areas (Left, Center, Right) on both sides of the court (player side and target side) between the singles side lines (each alley is considered a half-lane in doubles). Each lane can be further divided into three sublanes (Left, Center, Right). |
| Zones | The three horizontal areas (Front, Middle, Back) on both sides of the court (player side and target side) between the singles side lines (alleys logically extend zones, in doubles). Each zone can be further divided into three subzones (Front, Middle, Back). |
| Sectors | The nine specific locations (Front & Back, Center, Left & Right, Left-Front & Left-Back, Right-Front & Right-Back) on both sides of the court, formed by the intersecting general vertical lanes and the general horizontal zones; and having specific and unique charactersitics of both dimensions combined. Each sector can be further divided into nine subsectors. |
| Player Sector | The specific sector location from which a ball is hit with a racket by a player (though not necessarily the sector on which the player is also standing). |
| Target Sector | The specific sector location at which a ball is aimed by a player (though not necessarily the sector that is actually hit by the ball when shot). |
| Subsectors | The nine specific locations of a sector, formed by dividing the sector vertically into three sublanes and horizontally into three subzones. |
| Supersectors | The two general locations on either side of a tennis court, betwen the singles side lines, including all nine sectors on either side (but not the two alleys). |
| Types | Three generic terms (sides, center, corners) used to classify all nine sectors on either side of court, and all nine subsectors of each sector into: 4 sides (left & right, and front & back); 4 corners (left-front & left-back, and right-front & right-back); and 1 center (The Key). |

I claim:

1. An improved surface for a tennis court having on each side of a net playing areas defined in the front by the net, in the back by a baseline, on the sides by single side lines wherein the improvement comprises means for physically identifying at least one sector on one of said playing areas, each sector being defined as one of nine areas for each playing area determined by dividing each playing area into three equal lanes parallel to the net and into three equal zones perpendicular to the net.

2. The improved playing surface of claim 1 wherein the improvement further comprises second means for physically identifying at least one sector on the other playing area.

3. The improved playing surface of claim 1 wherein the identifying means identify all nine sectors on the playing area.

4. The improved playing surface of claim 3 wherein the identified sectors are colored in a checkerboard pattern.

5. The improved playing surface of claim 1 wherein the identifying means are removable.

6. The improved playing surface of claim 5 wherein the identifying means further includes markings corresponding to traditional court marks.

* * * * *